US006620175B1

(12) United States Patent
Sueyoshi et al.

(10) Patent No.: US 6,620,175 B1
(45) Date of Patent: Sep. 16, 2003

(54) HAIR REMOVING DEVICE AND METHOD

(75) Inventors: Hidekazu Sueyoshi, Kanzaki (JP); Naoki Taniguchi, Sakata (JP); Jyuzaemon Iwasaki, Hikone (JP); Naoki Yamaguchi, Hikone (JP); Toshihiro Takeuchi, Hikone (JP); Tomoyuki Inoue, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 189 days.

(21) Appl. No.: 09/718,359

(22) Filed: Nov. 24, 2000

(30) Foreign Application Priority Data

Nov. 25, 1999 (JP) ..... 11-333562

(51) Int. Cl.[7] ..... A45D 26/00
(52) U.S. Cl. ..... 606/133
(58) Field of Search ..... 606/133, 131; 30/41, 45, 538; 277/345, 390, 392, 407, 590

(56) References Cited

U.S. PATENT DOCUMENTS 4,575,902 A 3/1986 Alazet
4,604,800 A * 8/1986 Yamamoto et al.
5,458,607 A * 10/1995 Heintke et al.
5,507,753 A * 4/1996 Iwasaki et al.
5,797,925 A 8/1998 Heintke
5,976,157 A 11/1999 Yiu

FOREIGN PATENT DOCUMENTS

EP 0622033 11/1994
JP 9-308521 12/1997

* cited by examiner

*Primary Examiner*—Ismael Izaguirre
(74) *Attorney, Agent, or Firm*—Greenblum & Bernstein, P.L.C.

(57) ABSTRACT

A hair removing device and method. The device includes a rotatable cylinder having a hair removing unit provided with a plurality of detents configured to engage and disengage each other. The hair removing unit is configured to pull out hair through rotation of the rotatable cylinder. Also provided is a driving source configured to rotate the rotatable cylinder, a drive transmission configured to transmit driving force from the driving source to the rotatable cylinder, a housing having a handheld configuration and configured to house at least the driving source and at least a portion of the drive transmission, and a water-resistant member affixed to the housing at substantially a middle, portion of the drive transmission and configured to substantially water-resistantly seal the driving source.

22 Claims, 20 Drawing Sheets

HAIR REMOVING DEVICE AND METHOD

BACKGROUND OF THE INVENTION

1. Field of the Invention

The present invention is related to a hair removing device for removing unwanted body hair for the personal grooming and the like.

2. Background and Material Information

A known hair removing device is disclosed in the Japanese Unexamined Patent Publication No. HEI 9-308521, shown in FIGS. 19 and 20. In this known device, a motor 3 is rotated to rotate a roller unit 51 via a belt 56, the roller unit having a plurality of disks. Unwanted body hair is caught and pulled out by the disk due to the rotation of the roller unit 51. A cleaning element 53 having a bristle brush is provided in a casing 52. Body hair accumulated in the disk for catching and pulling out the body hair is removed by the cleaning element 53 and falls into a partition. The body hair from the partition may be emptied by removing a cover 54.

While the body hair accumulated in the disks is removed through the cleaning element 53, in the above-described known device, body hair cannot be sufficiently emptied from this device. Moreover, hair follicles, sebum and other fatty or sebaceous secretions pulled out by this device along with body hair have the tendency to adhere to the inside of the device, thereby making it difficult to empty and clean the device.

In addition, rotational driving force of the motor 3 is transmitted to the roller unit 51 via a belt 56, as shown in FIG. 19. In the area where the belt 56 is provided, a gap 55 exists between the roller unit 51 and the motor 3. Such an arrangement is often problematic in that body hair, sebum and other unwanted organic matter through the gap 55 into the portion of the device housing the motor 3, thereby reducing the life of the device. Further, the roller unit 51 portion having the body hair, sebum and other organic matter stuck thereto cannot be washed with water without destroying the device, as this device is not water resistant.

SUMMARY OF THE INVENTION

The present invention provides a hair-removing device and method capable of preventing body hair, sebum and other unwanted organic matter and the like from entering the area of the driving source which would otherwise cause failure of the driving source. The present invention may be washed with water, thereby providing for the easy removal of body hair, sebum and other organic matter wound or stuck onto a rotary cylinder or a detent.

With the present invention, hair, sebum and the like do not enter a portion of the device that houses a driving source, thereby preventing possible failure of the driving source. Body hair, sebum and the like that is wound or stuck onto a rotary cylinder, or body hair, sebum and the like that is stuck onto a detent can easily be removed by washing the device with water.

The hair removing device of the present invention provides a rotatable cylinder having a hair removing unit provided with a plurality of detents configured to engage and disengage each other, the hair removing unit configured to pull out hair through rotation of the rotatable cylinder. Also provided is a driving source configured to rotate the rotatable cylinder, and a drive transmission configured to transmit driving force from the driving source to the rotatable cylinder. The present invention also includes a housing having a handheld configuration and configured to house at least the driving source and at least a portion of the drive transmission, and a first water-resistant member affixed to the housing at substantially a middle portion of the drive transmission and configured to substantially water-resistantly seal the driving source. With such a structure, the water-resistant member can prevent body hair, sebum and other unwanted material from entering the housing. By washing the rotatable cylinder and the detents with water, moreover, hair (e.g., pulled out body hair, hair torn into pieces during removal or the like) and sebum which are wound or stuck onto the rotatable cylinder or hair and sebum which are stuck to the detents can be easily removed. Also, the water-resistant member prevents water from entering the housing which would otherwise damage the driving source housed therein, so that washing can be easily and safely performed.

Moreover, the present invention may further include a rotatable cylinder gear operably connected to the rotatable cylinder, wherein the drive transmission includes a gear train configured to transmit the driving force from the driving source to the rotatable cylinder gear, and wherein the gear train is provided with the first water-resistant member. With such a structure, the water-resistant member is provided for water-resistantly sealing the gear train portion to transmit driving force to the gear provided on the rotatable cylinder in a manner different from a prior art structure in which driving force is transmitted through a belt in order to rotate the rotatable cylinder. Consequently, water-resistant sealing can be easily achieved with the simple structure of the present invention.

Furthermore, the present invention may further include a base housed within the housing and having a plurality of base portions, at least one of the base portions configured to rotatably support a shaft of a gear of the gear train. The first water-resistant member may include a first water-resistant portion configured to substantially water-resistantly seal a region of the gear of the gear train, and a second water-resistant portion configured to substantially water-resistantly seal a region between the base portion that is configured to rotatably support the shaft of the gear of the gear train and another base portion. With such a structure, it is possible to water seal regions between the bases for rotatably supporting the shaft of the gear, in addition to the reduction gear portion, through the water-resistant member, in order to water seal the housing against entry of water from the rotatable cylinder, at the middle of the gear train.

Moreover, the first and second water-resistant portions may be integrally formed with the base portion that is configured to rotatably support the shaft of the gear of the gear train. By such integral formation of the water-resistant member with one of the bases, the number of parts can be reduced.

The base of the present invention may be housed within the housing and include a plurality of base portions, at least one of the base portions being configured to rotatably support a shaft, and the invention may further include a pair of gears of the gear train coaxially positioned about the shaft, wherein at least a portion the first water-resistant member is positioned between the pair of gears. Since water-sealing is carried out by the water-resistant member on the shaft portion between the gears fixed to both sides of the shaft of the reduction gear, the driving source side can be sealed against entry of water from the rotatable cylinder.

Further, the first water-resistant member may be further configured to substantially water-resistantly seal a portion of the gear train provided in the housing, and the rotatable cylinder may be readily removable from and attachable to the housing. With such a structure, the rotatable cylinder can be easily removed from and reattached to the housing for cleaning. Consequently, a part of the gear train in the housing can be cleaned. In addition, the rotatable cylinder can be removed, so that the rotatable cylinder alone can be washed with water.

Also, the first water-resistant member may be further configured to substantially water-resistantly seal a shaft portion of a gear of the gear train directly rotatably engaging the rotatable cylinder gear. With such a structure, hair and sebum may be prevented from entering the part of the housing where the gear train is provided. It is thus preferable that only the part of the invention housing the rotatable cylinder should be cleaned. Hair, sebum and the like can easily be removed by washing with water.

The invention may further include a hair removing head that houses the rotatable cylinder, the head being readily removable from and attachable to the housing, and may also include a rotary shaft protruding from the housing and driveably connected to the driving source, wherein the rotatable cylinder is driveably connected to the rotary shaft when the head is attached to the housing, and wherein the first water-resistant member is further configured to substantially water-resistantly seal the housing at a region of the rotary shaft. With such a simple structure wherein the water-resistant member is attached to the rotary shaft on the on the same side of the housing as the driving source, to effect water sealing, the driving source side can be water sealed against the entry of water from the rotatable cylinder. In addition, it is sufficient to remove the hair removing head so that only the hair removing head portion of the invention is cleaned. Besides, the hair removing head can be removed and the hair removing head can be easily washed with water or other cleaning substance.

Also, in the present invention at least a portion of the gear train may be housed in the hair removing head. With such a structure, the hair wound onto the gear train can easily be removed by washing with water.

The driving source of the present invention may include a motor operably connected to the gear train, and the device of the present invention may further have a second water-resistant member positioned between the housing and an upper outer periphery of the base. With such a structure, the second water-resistant member can prevent hair, sebum and other unwanted material from entering the housing from a region between the housing and the base, and water can be prevented from entering the housing from the region between the housing and the base into an inner portion during washing. As a result, it is sufficient that the base having the motor and the gear train provided therein has a structure in which only an upper part need be water sealed in the housing, and the structure of the second water-resistant member and the structure of a portion other then the upper part of the base is simplified.

The base may further include an aperture for accepting at least a portion of a gear of the gear train, and the hair removing device may further include a drive transmission passage extending between the motor and the aperture, wherein the first water-resistant member is provided at a substantially middle portion of the drive transmission passage. With such a structure, the water-resistant member can prevent hair, sebum, water and the like from entering the portion of the housing between the motor and the aperture of the base.

The base may further have a motor installing base portion configured to accept the motor therein, and the hair removing device may further have a gear train installing portion configured to accept at least another portion of the gear of the gear train, and a partition configured to separate the motor installing base portion and the gear train installing portion. With such a structure, the partition can prevent hair, sebum, water and the like from entering the housing from the gear train.

Further, the driving source may further include a motor operably connected to the gear train. Also, a number of the plurality of base portions may be configured to house the motor and at least a portion of the gear train. With such a structure, it is possible more simply incorporate the driving source into the base and to incorporate the gear train therein.

The present invention may additionally include a boss provided on one of the gear and shaft of the gear train, wherein the first water-resistant portion includes an annular member fitted in the boss. The second water-resistant portion includes a band-shaped frame member configured to continuously substantially water-resistantly seal the region between the base portion configured to rotatably support the shaft of the gear of the gear train and the another base portion. With such a structure, when the annular member is fitted in the boss provided on the gear or the shaft of the gear, water sealing can be carried out in the middle of the gear train. Moreover, water sealing can be carried out at the border between the bases divided by the band-shaped frame member. The water sealing can continuously be carried out in the middle of the gear train and in the border between the bases through one water-resistant member.

The base may further have an upper base portion having an aperture therein, and the gear train may include a first reduction gear having a small gear and a large gear coaxial to one another, a second reduction gear having a small gear and a large gear coaxial to one another, the large gear of the second reduction gear operably mated to the small gear of the first reduction gear. A boss portion may be positioned between the small gear and the large gear of the second reduction gear, the annular member being fitted in the boss portion, an output shaft operably connected to the motor and protruding into the gear train installing portion, and an output gear operably mated to the small gear of the second reduction gear. Thus, at least a portion of the output gear is housed within the aperture of the upper base portion. Also, a pinion may be affixed to the output shaft, wherein the large gear of the first reduction gear is operably mated to the pinion. The first water-resistant member may be configured to substantially water-resistantly seal the driving source at at least a portion of at least one of the first and second reduction gears. With such a structure, the water-resistant member can be attached to the reduction gear portion of the reduction gears which are closer to the rotatable cylinder, thereby carrying out the water sealing. Consequently, hair, sebum and water do not enter the portion of the housing that houses the reduction gears proximate the motor. Also, the gear train provided at the base can be positioned at the opening portion of the upper base with the outer peripheral portion thereof water sealed by the second water-resistant member against the housing.

Furthermore, the gear train may include a driving gear operably connected to the rotatable cylinder gear, and the hair removing head that houses the rotatable cylinder may also house the driving gear. The output gear may be operably connected to the driving source, wherein the driving gear is driveably connected to the output gear when the head is attached to the housing. With such a structure, the rotation of the motor can be transmitted to the rotatable cylinder to rotate the rotatable cylinder in order to attach or remove the hair removing head from the housing. In addition, the hair removing head can be removed and replaced to facilitate the cleaning thereof. In addition, the hair removing head can be removed, so that only the hair removing head is cleaned with water or other liquids.

The housing of the device of the present invention may be longitudinally divided into two half-housings affixed to one another, and a third water-resistant member may be positioned between at least a portion of the two half-housings. Thus, the housing is formed by bonding the half-housings so that the base and the like can easily be incorporated in the inner portion thereof. Irrespective of the structure being divided in half, the second water-resistant member can easily prevent hair, sebum and water from entering the housing from the area of attachment of the half-housings.

The base of the present invention may house the motor and may further have an aperture therein, wherein the device of the present invention may have a second water-resistant member positioned between the housing and an upper outer periphery of the base, and a rotary shaft driveably connected to the motor and the gear train, the rotary shaft protruding through the aperture. The first water-resistant member is positioned between an inner peripheral portion of the aperture and an outer peripheral portion of the rotary shaft. With such a structure, water-resistance may be provided by the second water-resistant member at an area between the housing and the upper outer periphery of the base. In addition, the water-resistant member can water-resistantly seal the rotary shaft extending from the aperture of the base. Consequently, the motor provided in the base can water sealed against water entering from the area of the rotatable cylinder. Since the second water-resistant member is provided, it is not necessary to consider water sealing at the region of the base housing the motor. Consequently, the structure for incorporation of the motor into the base is simplified.

Also, the rotary shaft of the device of the present invention may further include an engaging portion on an end thereof, and the gear train may include a gear disposed within the hair removing head and operably connected to the rotatable cylinder gear, and the gear may have a fitting aperture configured to accept the rotary shaft. The fitting aperture may have an engaged portion for removably engaging the engaging portion. With such a structure, the hair removing head can be easily attached and removed. When the hair removing head is attached to the housing, the engaging portion is engaged with the engaged portion so that the rotation of the rotary shaft can be transmitted to the gear on a starting end of the gear train provided in the hair removing head.

The hair removing method of the present invention includes housing at least a driving source and at least a portion of a drive transmission, rotating a rotatable cylinder via the driving source, opening and closing at least one of the plurality of detents, and substantially water-resistantly sealing the driving source with a first water-resistant member affixed to the housing at substantially a middle portion of the drive transmission.

The method may further include operably connecting a rotatable cylinder gear to the rotatable cylinder, transmitting driving force from the driving source to a rotatable cylinder gear, and providing a gear train with the first water-resistant member.

Additionally, the method may include rotatably supporting, on at least one of a plurality of base portions, a shaft of a gear of the gear train, substantially water-resistantly sealing, using a first water-resistant portion of the first water-resistant member, a region of the gear of the gear train, and substantially water-resistantly sealing, using a second water-resistant portion of the first water-resistant member, a region between the base portion supporting the shaft of the gear of the gear train and another base portion. The method also include integrally forming the first and second water-resistant portions with the base portion rotatably supporting the shaft of the gear of the gear train.

The method may additionally include rotatably supporting a shaft using at least one of the base portions, coaxially positioning a pair of gears of the gear train about the shaft, and positioning at least a portion the first water-resistant member between the pair of gears.

Further, the hair removing method may include substantially water-resistantly sealing a portion of the gear train provided in the housing, using the first water-resistant member, and configuring the rotatable cylinder so that it is removable from and attachable to the housing.

The hair removing method may also include substantially water-resistantly sealing, using the first water-resistant member, a shaft portion of a gear of the gear train directly rotatably engaging the rotatable cylinder gear.

The method may also include housing the rotatable cylinder in a hair removing head that is removable from and attachable to the housing, driveably connecting a rotary shaft protruding from the housing to the driving source, driveably connecting the rotatable cylinder to the rotary shaft when the head is attached to the housing, and substantially water-resistantly sealing, using the first water-resistant member, the housing at a region of the rotary shaft.

The method may further include operably connecting a rotatable cylinder gear to the rotatable cylinder, transmitting the driving force from the driving source to the rotatable cylinder gear using a gear train, when the hair removing head is attached to the housing, and housing at least a portion of the gear train in the hair removing head.

Additionally, the hair removing method may further include operably connecting the motor to the gear train, housing a base housed within the housing, housing the motor within the base, and providing a second water-resistant member between the housing and an upper outer periphery of the base.

The method may further include providing an aperture on the base, the aperture accepting at least a portion of a gear of the gear train, providing a drive transmission passage extending between the motor and the aperture, and providing the first water-resistant member at a substantially middle portion of the drive transmission passage.

Also, the method may include housing the motor in a motor installing base portion, accepting, in a gear train installing portion, at least another portion of the gear of the gear train, and separating, using a partition, the motor installing base portion and the gear train installing portion.

Further, the hair removing method may include operably connecting the motor to the gear train, and housing, in a number of the plurality of the base portions, the motor and at least a portion of the gear train.

Additionally, the first water-resistant portion may include an annular member fitted in a boss provided on one of the gear of the gear train and the shaft of the gear train, and the second water-resistant portion may include a band-shaped frame member. The method may include continuously substantially water-resistantly sealing, with the band-shaped frame member, the region between the base portion rotatably supporting the shaft of the gear of the gear train and the another base portion.

The method may further include operably connecting the motor to the gear train, accepting the motor in the motor installing base portion, providing an aperture in the base portion, accepting, in a gear train installing portion, at least a portion of a gear of the gear train, operably connecting the large gear of the second reduction gear to the small gear of the first reduction gear, positioning a boss portion between the small gear and the large gear of the second reduction gear, fitting the annular member in the boss portion, operably connecting an output shaft to the motor, protruding the output shaft into the gear train installing portion, operably connecting an output gear to the small gear of the second reduction gear, housing at least a portion of the output gear in the aperture of the upper base portion, affixing a pinion to the output shaft, operably connecting the large gear of the first reduction gear to the pinion, and substantially water-resistantly sealing, with the first water-resistant member, the driving source at at least a portion of at least one of the first and second reduction gears.

The hair removing method may additionally include operably connecting a driving gear to the rotatable cylinder gear, housing the rotatable cylinder in a hair removing head that is removable from and attachable to the housing, operably connecting an output gear to the driving source, and driveably connecting the driving gear to the output gear when the head is attached to the housing.

The method may further include longitudinally dividing the housing into two half-housings, affixing the half-housings to one another, and positioning a third water-resistant member between at least a portion of the two half-housings.

The method may yet further include housing a base within the housing; housing the motor in the base; providing an aperture in the base; positioning a second water-resistant member between the housing and an upper outer periphery of the base, and driveably connecting a rotary shaft to the motor and the gear train, protruding the rotary shaft through the aperture, and positioning the first water-resistant member between an inner peripheral portion of the aperture and an outer peripheral portion of the rotary shaft.

The method may yet still further include providing an engaging portion on an end of the rotary shaft, providing a gear within the hair removing head, operably connecting the gear to the rotatable cylinder gear, providing a fitting aperture in the gear, accepting the rotary shaft in the fitting aperture, providing an engaged portion in the fitting aperture, and configuring the engaged portion for removably engaging the engaging portion.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of preferred embodiments of the present invention, in which like numerals represent like elements throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
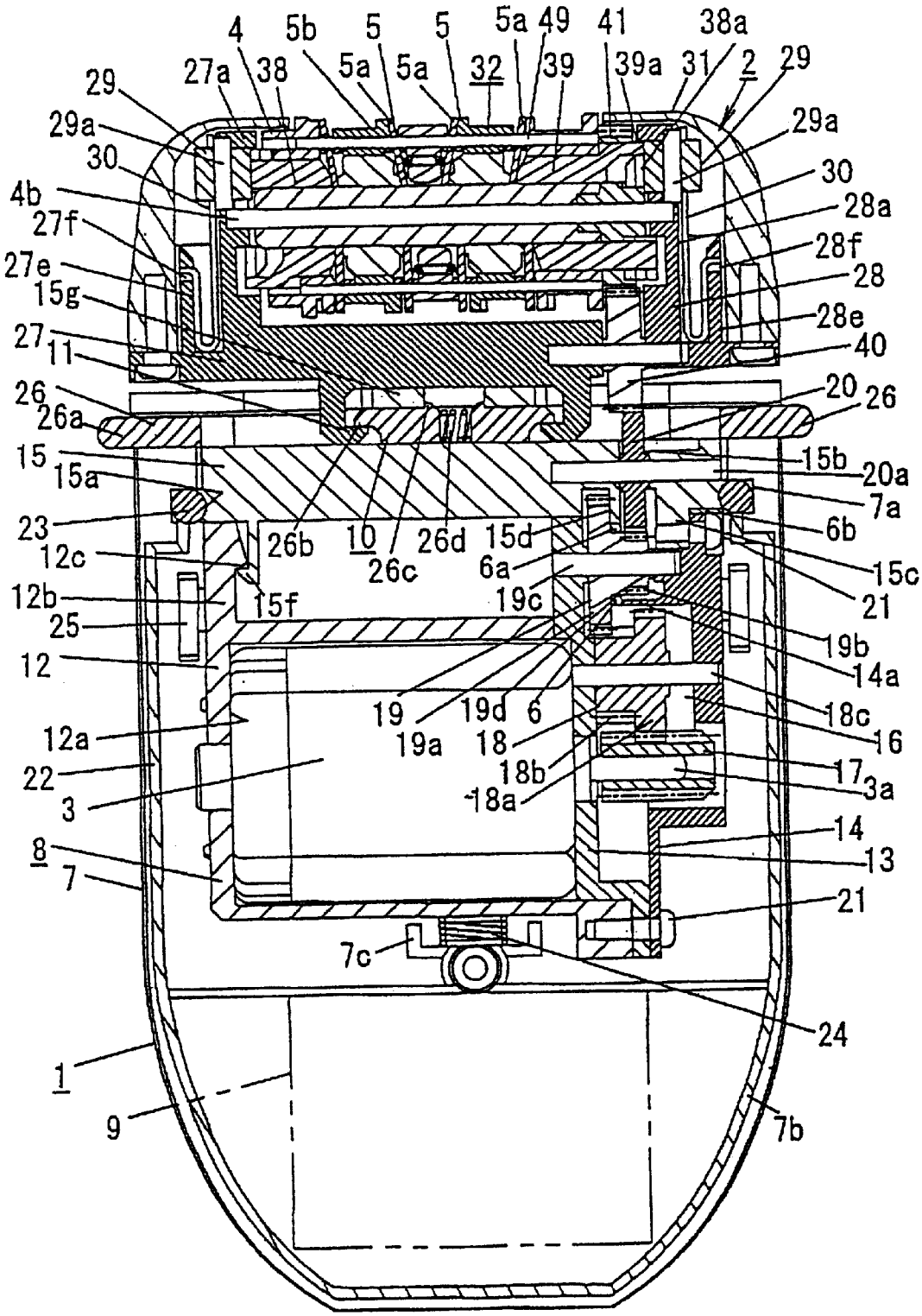
FIG. 1 is a sectional front view showing a hair removing device of the present invention.
Figure 2:
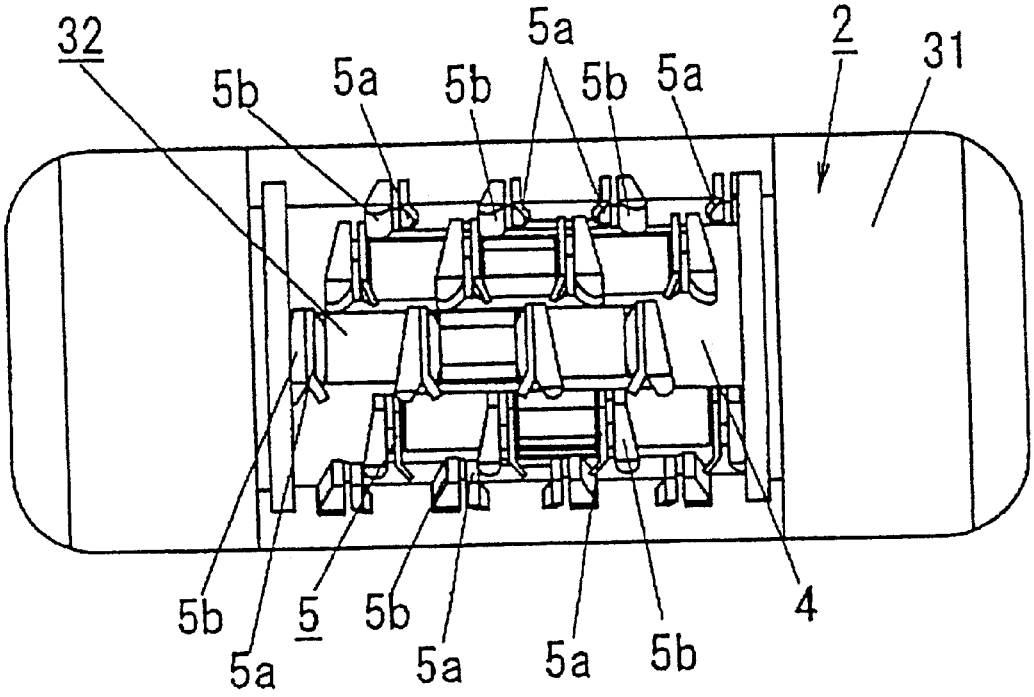
FIG. 2 is a plan view showing the hair removing device of the present invention.
Figure 3:
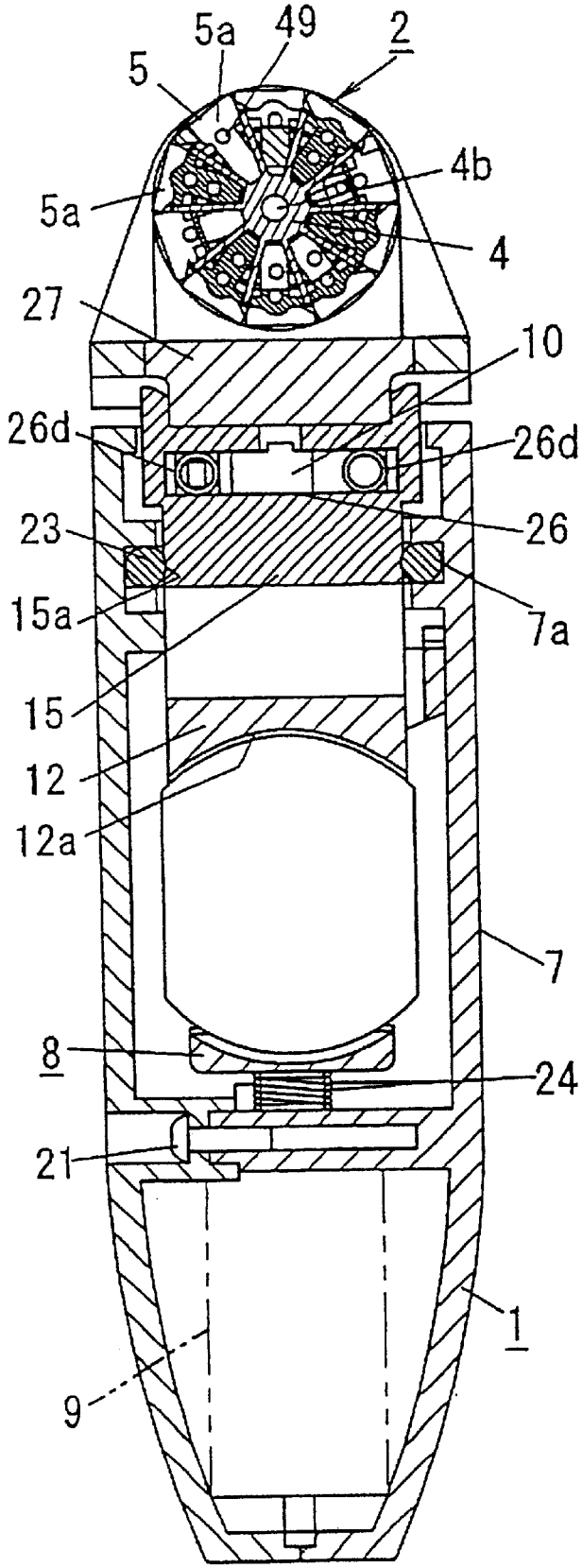
FIG. 3 is a sectional side view showing the hair removing device of the present invention, taken along a central portion.
Figure 4:
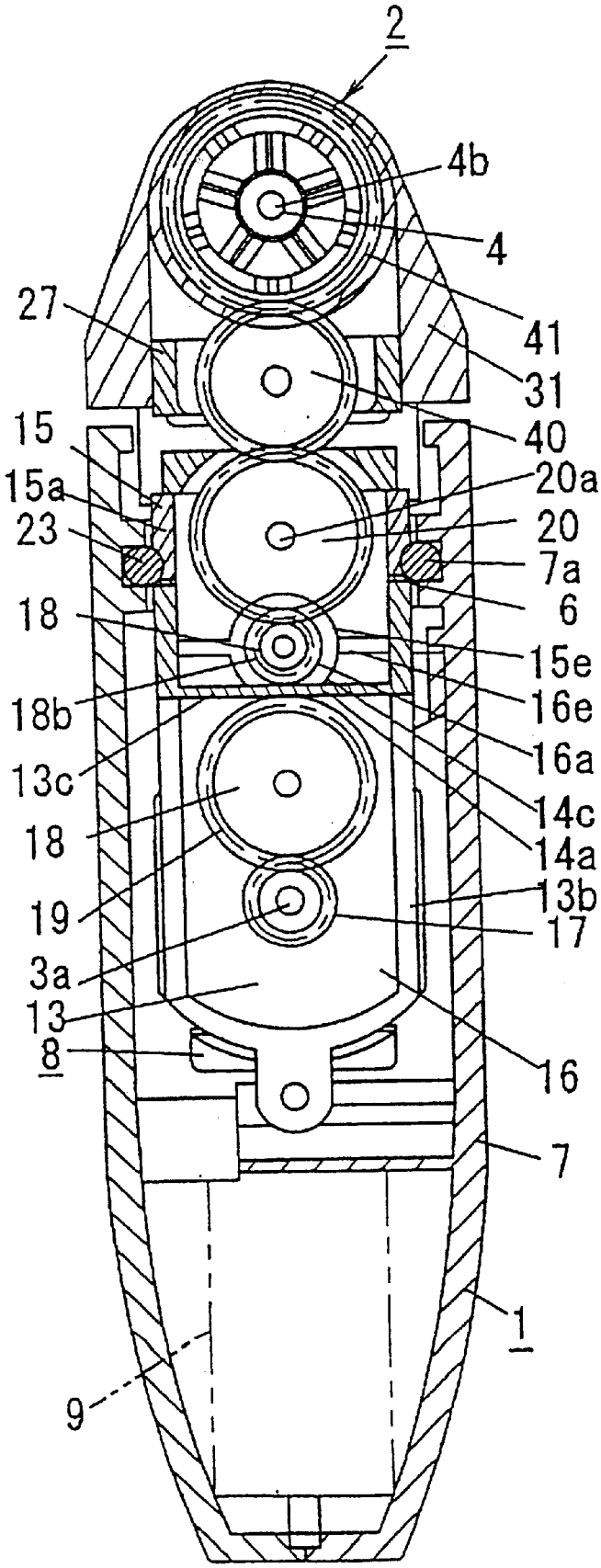
FIG. 4 is a sectional side view showing the hair removing device of the present invention, taken along an edge portion.

Referring to the drawings wherein like numerals represent like elements, FIG. 1 shows a hair removing device according to the present invention. The hair removing device has a housing 1 having a handheld configuration (i.e., the housing is dimensioned so that it may be easily be held in a hand). The device has a hair removing head 2, and the housing 1 has a motor 3 that serves as the driving source. The device further includes a rotatable cylinder 4, housed in the hair removing head 2.

The rotatable cylinder includes a plurality of detents 5 for opening and/or closing to catch hair, the detents being configured to hold and pull out hair through rotation of the cylinder. The rotation of the motor 3 is transmitted to the rotatable cylinder through a drive transmission such as a gear train, to rotate the rotatable cylinder 4. The hair is then held and pulled out of the skin.

The present invention is water-resistant and has a water-resistant member 6 for water sealing the motor 3 inside the housing at a portion of the housing 1 facing the rotatable cylinder 4. As shown in FIG. 1, the water-resistant member 6 is arranged in the middle of a gear train extending from the motor 3 to the rotatable cylinder 4 such that hair, sebum and water do not enter the housing 1 through the hair removing head when the hair removing head is attached to the housing. Particularly, a water-resistant structure is provided whereby water or other liquid does not enter the area of the housing where the motor 3 is installed. Consequently, the device may be safely and easily washed with water without potentially damaging the motor or other components inside the housing.

As shown in FIGS. 1, 3, 4 and 5, the housing 1 is constructed by bonding two half-housings 7 which are divided into two, substantially mirror-image portions in a longitudinal direction, and which has an open upper end. A base 8 that houses the motor 3 therein, and the gear train are installed in the housing 1. Furthermore, a dry cell-type battery or charger 9 for driving the motor 3 may be provided in the housing 1.

The upper surface of the base 8 closes the upper end opening of the housing 1 and is provided with a hook attachment portion 10. A pair of hooks 11 provided in a lower surface of the hair removing head 2 removably engage the hook attachment portion 10 so that the hair removing head 2 can be easily removably attached to and detached from to the housing 1.

Figure 5:
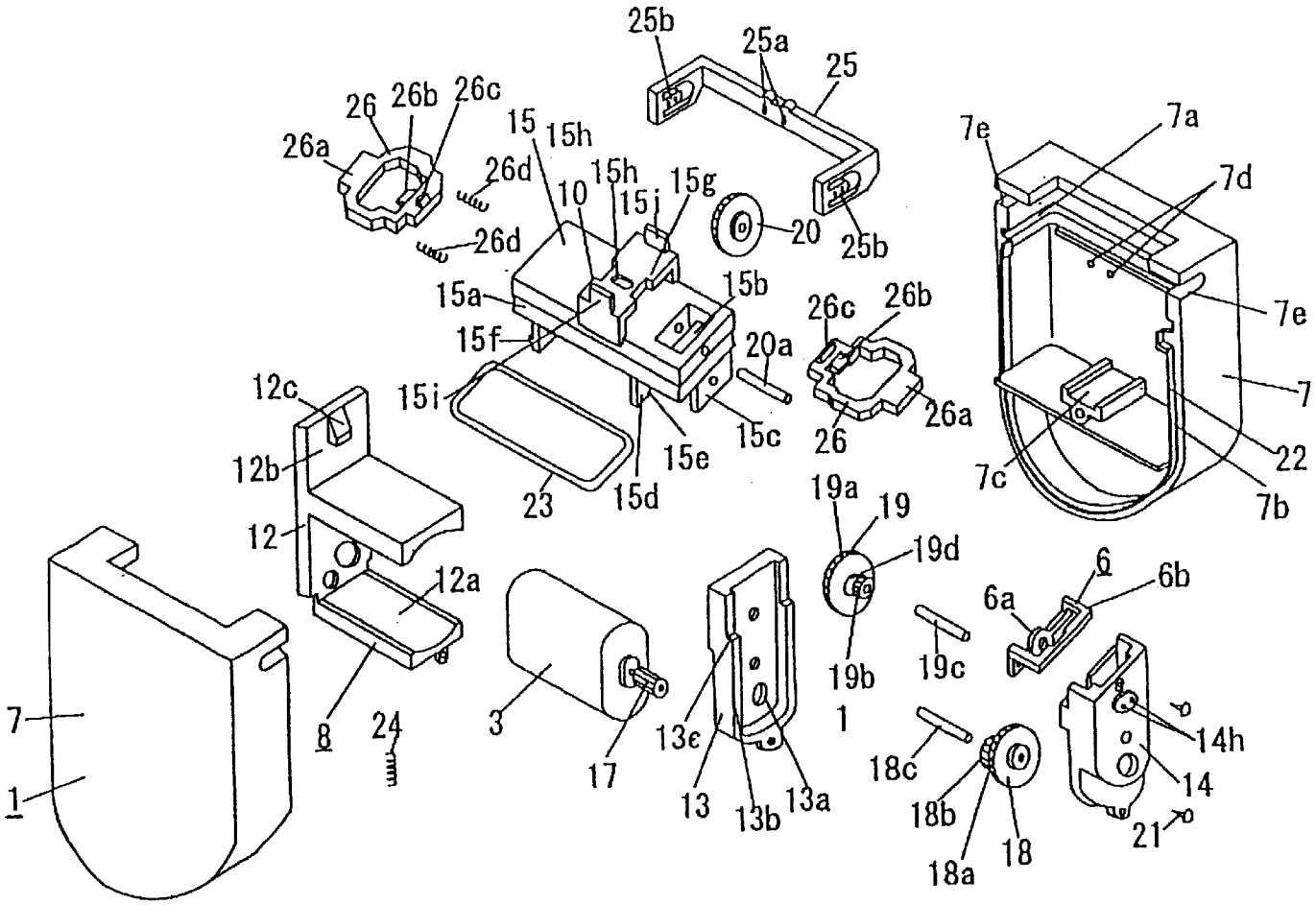
FIG. 5 is an exploded perspective view showing a housing portion of the hair removing device of the present invention.

As best shown in FIG. 5, the base 8 is constructed from a combination of a plurality of divided base portions 12, 13, 14 and 15. Specifically, in the present embodiment, the base 8 includes a motor installing base portion 12 for accepting the motor 3 therein, a motor cover base portion 13 for covering or enclosing the motor, a gear cover base portion 14 for covering an opposite side of the gear train from the motor cover base portion 13, and an upper base portion 15 for covering respective upper areas of the motor installing base portion 12, the motor cover base portion 13 and the gear cover base portion 14.

Also as shown in FIG. 5, the motor installing base portion 12 is provided with a generally U-shaped motor installing portion 12*a*, and an upwardly extending piece 12*b* that protrudes upwardly from one end of the upper surface of the motor installing portion 12*a* (i.e., generally orthogonal to the "arms of the U-shape). The upwardly extending piece 12*b* is provided with an engaging portion 12*c*. The motor 3 is fitted and installed in the U-shaped motor installing portion 12*a* through a side opening (i.e., between the "arms" of the U-shape). The motor cover base portion 13 is attached to the side opening portion of the U-shaped motor installing portion 12*a*, thereby closing the open end of the U-shape.

Furthermore, the gear cover base portion 14 is attached to the outside of the motor cover base portion 13 on a side of the motor cover base portion not facing the motor 3. A space between the motor cover base 13 and the gear cover base 14 serves as a gear train installing portion 16 that houses the gear train therein. Further the motor cover base portion 13 separates the motor installing portion 12*a* and the gear train installing portion 16.

An output shaft 3*a*, shown in FIG. 1, of the motor 3 is installed in the motor installing portion 12*a* and is inserted through an aperture 13*a* of the motor cover base 13. The output shaft 3*a* protrudes into the gear train installing portion 16, and a pinion 17 is fastened to a portion of the output shaft 3*a* that protrudes into the gear train installing portion 16. A plurality of reduction gears 18 and 19 are provided in the motor installing portion 12*a*. Reduction gear 18 includes a large gear 18*a* and a small gear 18*b*. Similarly, reduction gear 19 includes a large gear 19*a* and a small gear 19*b*. An end of each shaft 18*c* and 19*c* of reduction gears 18 and 19 is rotatably supported by a respective aperture provided in the motor cover base portion 13, and an opposite end of each shaft 18*c* and 19*c* is rotatably supported by a respective aperture provided in the gear cover base portion 14. Thus, the shafts 18*c* and 19*c* are supported in the gear train installing portion 16 between the motor cover base portion 13 and the gear cover base portion 14.

As best seen in FIG. 1, the large gear 18*a* of reduction gear 18 rotatably engages the pinion 17 (i.e., it is operably connected to the pinion). Reduction gear 19 is provided above the reduction gear 18 (as viewed in FIG. 1), and the large gear 19*a* of reduction gear 19 rotatably engages the small gear 18*b* of reduction gear 18. A boss 19*d* having a diameter which is greater than or equal to that of the small gear 19*b* is provided between the large gear 19*a* and the small gear 19*b* of the reduction gear 19.

Shown in FIG. 5, a U-shaped ridge 13*b* extends from the edges and lower of the motor cover base portion 13 in a direction facing the gear cover base portion 14. A step portion 13*c* is provided at the ends of both arms of the "U" of the U-shaped ridge 13*b*.

Figure 7:
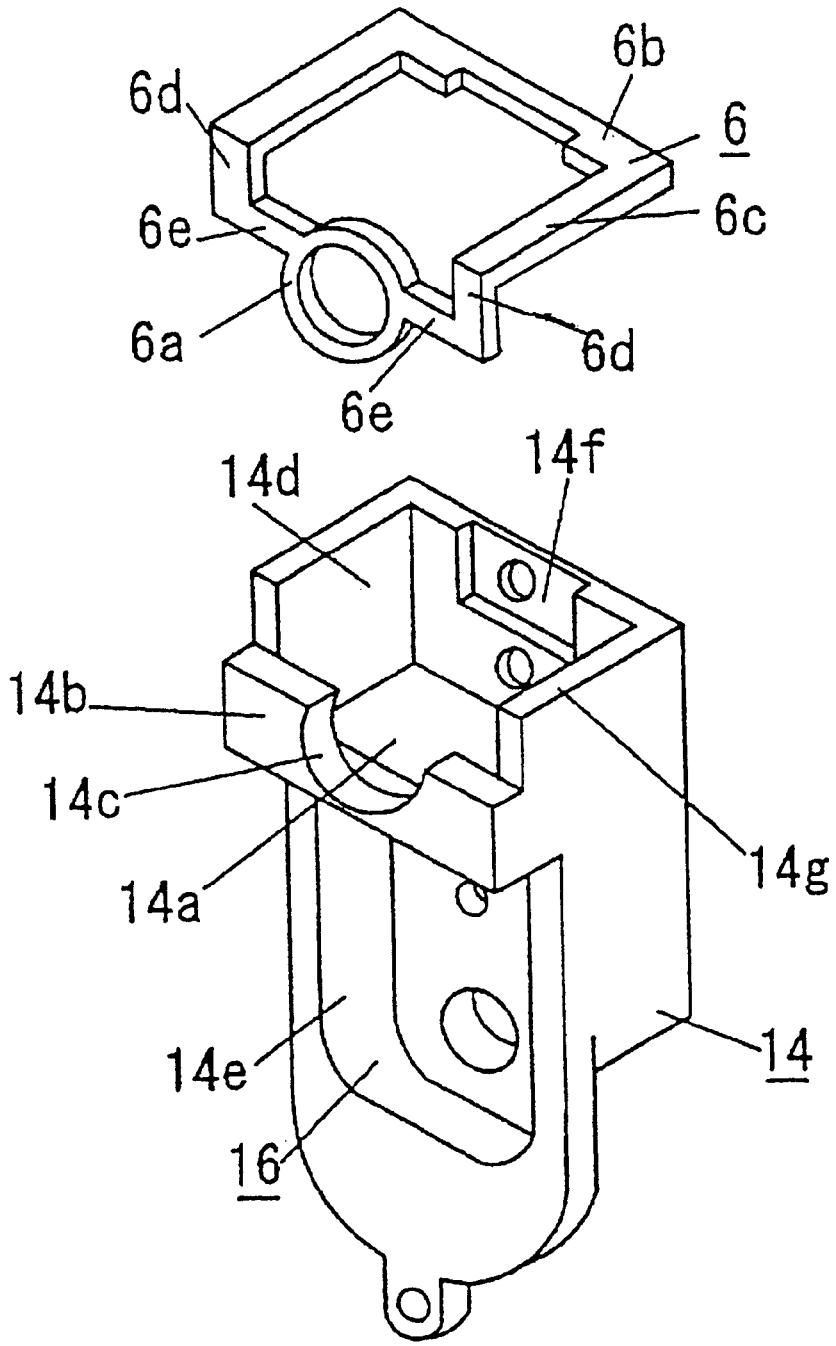
FIG. 7 is an exploded perspective view showing the water-resistant member and the gear cover base portion of the hair removing device of the present invention.

As shown in FIG. 7, an inner surface portion of the gear cover base portion 14 (i.e., a surface of the gear cover base portion facing the motor cover base portion 13) is a concave portion. A protruding wall 14*a* is provided in the upper portion of the concave portion of the gear cover base 14 in a horizontal direction (i.e., in a direction substantially parallel to the rotational axes of shafts 18*c* and 19*c*). The protruding wall vertically divides the concave portion into an upper concave portion 14*d* and a lower concave portion 14*e*. A rising portion 14*b* is formed at an upper edge portion of a vertical face of the protruding wall 14*a* that faces the motor cover base portion 13, and a lower semicircular fitting portion 14*c* is semicircularly concavely provided in a central part of the rising portion 14*b*. A substantially lower half of the lower semicircular fitting portion 14*b* is positioned below the upper edge portion of a vertical face of the protruding wall 14*a* that faces the motor cover base portion 13. The upper edge portion of a vertical face of the protruding wall 14*a* that faces the motor cover base portion 13 is exposed to a substantially lower half portion of the lower semicircular fitting portion 14*b*, as shown in FIG. 7.

Moreover, a portion of the rising portion 14*b*, with the exception of the substantially lower half of the lower semicircular fitting portion 14*c*, extends upwardly above the upper surface of the protruding wall 14*a*. Both side walls 14*g* of the upper concave portion 14*d* extend in a direction orthogonal to the protruding wall 14*a* and extend beyond both side walls of the lower concave portion 14*e* and toward the motor cover base portion 13. Further, each side wall has a vertical surface facing the motor cover base portion 13, and a horizontal surface parallel to the protruding wall 14*a*.

Figure 6:
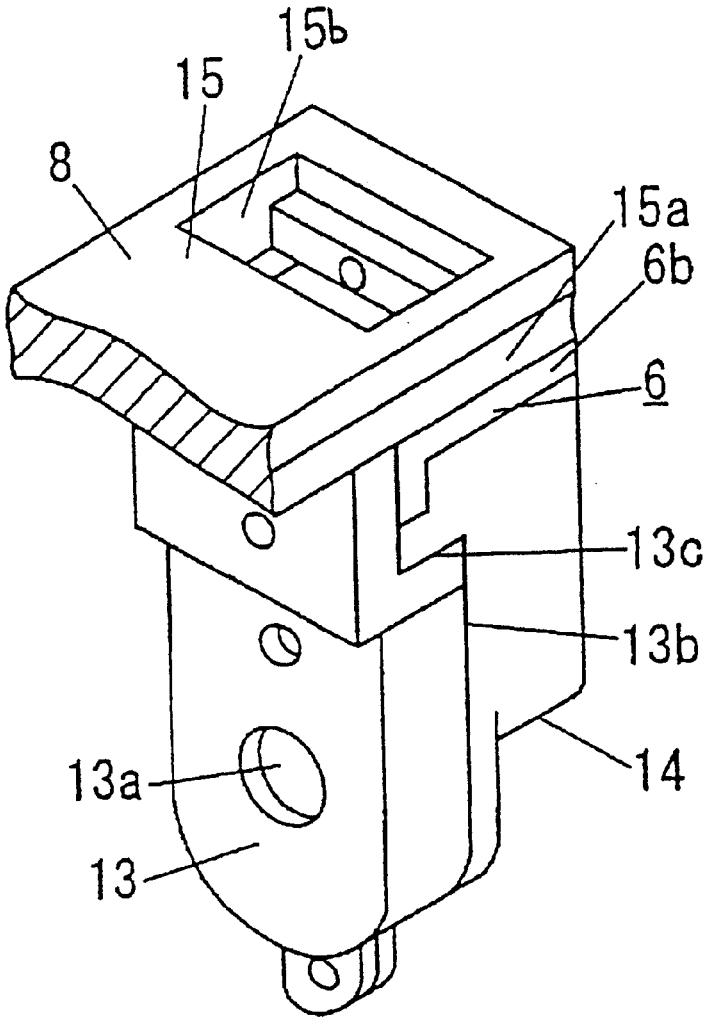
FIG. 6 is a perspective view showing the water-resistant member attached to a edge portion of a gear cover base portion, a motor cover base portion and an upper base portion of the present invention.

Further, the rising portion 14*b* further extends toward the motor cover base portion 13 side from both side walls 14*g* of the upper concave portion 14*d*. As shown in FIG. 6, a protruding portion of the rising portion 14*b* fits into the step potion 13*c* of the motor cover base portion 13. An outer peripheral edge surface of the lower concave portion 14*e* abuts a portion of the U-shaped ridge 13*b* at a region lower than the step portion 13*c*. Moreover, a positioning concave portion 14*f* is formed in the upper concave portion 14*e* on a surface opposed to the rising portion 14*b*.

As shown in FIG. 5, the upper base portion 15 has substantially the same shape as that of the upper end opening of the housing 1. A second water-resistant member fitting groove portion 15*a* is formed about an outer peripheral edge portion, and a second ring-shaped elastomeric water-resistant member 23 is fitted about the second water-resistant member fitting groove portion 15*a*. An aperture 15*b* is provided in the upper base portion 15 proximate an edge thereof. A fixing piece 15*c* is affixed to an edge of the upper base portion 15 on the underside thereof, extending in a direction substantially parallel to reduction gears 18 and 19. A suspending wall 15*d* is provided on the underside of the upper base portion 15 on an inner side thereof and substantially parallel to the fixing piece 15*c*, with the aperture 15*b* disposed between the fixing piece 15*c* and suspending wall 15*d*.

An upper semicircular fitting portion 15*e* having a substantially semicircular configuration is formed in the central part of a distal end of the suspending wall 15*d*. Moreover, an engaged portion 15*f* is formed on an edge of the upper base portion 15 opposite the edge where the fixing piece 15*c* affixed. Furthermore, a protrusion 15*g* for a tunnel having a tunnel passage is provided and extends upward in a central portion of the upper surface portion of the upper base portion 15. A hole 15*h* is provided in the central part of the upper surface portion of the protrusion 15*g* for a tunnel, and a protruded support piece 15*i* is provided and extends upwardly at both opposed edges of the protrusion 15*g* in a direction orthogonal to the tunnel passage of the upper surface portion of the protrusion 15*g*. Moreover, an output gear 20 is provided in the aperture 15*b* and a shaft 20*a* of the output gear 20 is rotatably supported by opposed internal wall portions of the aperture 15*b*.

The respective lower ends of the motor installing base 12 portion, the motor cover base portion 13 and the gear cover base 14 are fastened together by a screw 21 inserted from the gear cover base 14 side into holes provided on these respective lower ends. Moreover, the upper base 15 is affixed over the respective upper ends of the motor installing base portion 12, the motor cover base portion 13 and the gear cover base portion 14. The engaged portion 15*f* engages the engaging portion 12*c* provided on the motor installing base portion 12. Furthermore, the gear cover base portion 14 and the fixing piece 15*c* are affixed together by the screw 21, wherein the fixing piece 15*c* of the upper base portion 15 is fitted and positioned in the positioning concave portion 14*f* of the gear cover base portion 14.

In the present invention, the water-resistant member 6 is provided in the middle of the gear train, thereby preventing hair, sebum, water and other unwanted material from entering the housing through the aperture 15*b* of the upper base portion 15.

Referring to FIG. 7, the water-resistant member 6 is elastomeric, and is formed by integrating a first water-resistant portion for substantially water-resistantly sealing a reduction gear portion, and a second water-resistant portion for substantially water-resistantly sealing separation seams between divided base portions 13, 14 and 15. The first water-resistant portion is includes an annular member 6*a* to be fitted in the boss provided on the gear or the shaft of the gear, and the second water-resistant portion includes a belt-shaped frame 6*b* for substantially water-resistantly sealing the separation areas between the bases 8. The belt-shaped frame 6*b* is formed by integrally suspending a vertical (i.e, in a direction substantially parallel to reduction gears 18 and 19) band-shaped portion 6*d* downward from both ends of a substantially sideways L-shaped band portion 6*c* and by integrally providing a lower transverse band-shaped portion 6*e* in such a direction as to extend from the annular member 6*a* to the lower end of the vertical band-shaped portion 6*d*. The annular member 6*a* is integrally provided between the tips of the lower transverse band-shaped portion 6*e* opposed to the band-shaped frame 6*b* so that the water-resistant member 6 is integrally formed.

In the water-resistant member 6, the aperture of the annular member 6*a* is substantially water-resistantly sealingly fitted in the boss 19*d* of the reduction gear 19. The L-shaped belt portion 6*c* is pressed and held vertically between the horizontal surface of the side wall 14*g* and edges of the aperture 15*b*. The vertical belt-shaped portion 6*d* is pressed and held by the step portion 13*c* part of the ridge 13*b* of the motor cover base portion 13 and the vertical surface of the side walls 14*g* of the upper concave portion 14*d*. The lower transverse band-shaped portion 6*e* is pressed and held between a distal end of the suspending wall 15*d* (the suspending wall being fitted between the vertical band-shaped portions 6*d* without clearance) and an upper surface of the rising portion 14*b*. The upper and lower halves of the annular member 6*a* are pressed and vertically held between the upper semicircular fitting portion 15*e* and the lower semicircular fitting portion 14*c*. The vertical face of the protruding wall 14*a* is pressed in contact with a side surface of the lower portion of the annular member 6*a*. FIG. 6 is a perspective view showing a portion where the water-resistant member 6 thus attached is provided in the joined portion of the gear cover base portion 14, the motor cover base portion 13 and the upper base portion 15.

The inside of the gear train installing portion 16 is water-resistantly divided by the water-resistant member into the area of the housing 1 that houses the motor 3, and the area of the aperture 15*b*, by using the boss 19*d* portion of the reduction gear 19 as a boundary through the suspending wall 15*d*, the protruding wall 14*a* having the rising portion 14*b* and the water-resistant member 6 interposed therebetween. The large gear 18*a* of reduction gear 18 is positioned in a space communicating with the lower concave portion 14*e*, the small gear 19*b* of reduction gear 19 is positioned in the upper concave portion 14*d* under the aperture 15*b* and operably engages the output gear 20 provided in the aperture 15*b*. Accordingly, the water-resistant member 6 can prevent hair, sebum, water and other material from entering an inner portion of the housing through the aperture 15*b*.

A second water-resistant member fitting groove portion 7*a* is formed in an inner surface portion on an upper part of the half-housing 7. A third water-resistant member fitting groove portion 7*b* generally has a U-shape and runs along the region at which half-housings 7 are joined. Both upper ends (i.e., the tip of each arm of the U) of the third U-shaped water-resistant member fitting groove portion 7*b* communicate with the lower end of the second water-resistant member fitting groove portion 7*a*, shown in FIG. 5. The half-housings 7 are opposed to each other in a longitudinal direction and are bonded together with a screw to form the complete housing 1, wherein a front half portion and a rear half portion of the third water-resistant member 22 are each fitted in the third water-resistant member fitting groove portions 7*a* opposed to each other in the longitudinal direction. In this case, the base 8 housing the motor 3 and the gear train are arranged on the inside of the housing.

The outer half portion of the second water-resistant member 23 attached to the outer peripheral portion of the upper base 15 is fitted in the second water-resistant member fitting groove portion 7*a* of both divided half-housings 7, and both upper ends of the third U-shaped water-resistant member are pressed in contact with a lower surface of the second water-resistant member 23 respectively so that water-resistant sealing is continuously carried out at the region of attachment of the half-housings 7, and is further carried out at the inner surface portion of the housing 1 and the outer peripheral surface portion of the upper base 15 via the third water-resistant member 22 and the second water-resistant member 23.

The aperture 15*b* provided on the upper base 15 is the only part of the housing 1 that communicates with the outside. In addition, the water-resistant member 6 can prevent hair, sebum, water and the like from further entering the portion of the housing 1 that houses the motor 3 through the aperture 15*b*.

While the outer peripheral portion of the upper base 15 is elastomerically supported on the housing 1 via the second water-resistant member 23, the lower surface portion of the base 8 (i.e, the motor installing base portion 12) is further elastomerically supported via a spring member 24 supported on a spring support portion 7*c* provided in the half-housing 7. Moreover, a pair of support frame apertures 25*a* of a support frame 25 having a side piece substantially orthogonally extending from an opposed end, are fitted on respective protrusions 7*d* provided below the second water-resistant member fitting groove portion 15*a* on one of the half-housings 7, so that the support frame 25 may be affixed to the inside of the one of the half-housings 7. A U-shaped cut groove portion is formed on both side pieces of the support frame 25 so that an elastomeric coupling piece 25*b* is formed in a portion surrounded by the cut groove portion. A hole provided on the coupling piece 25 is fitted and attached into an attachment protrusion 14*h* provided in both the gear cover base portion 14 and the outer surface of the motor installing base portion 12. Consequently, the base 8 is further elastically supported in the housing 1 between the second water-resistant member 23 and the spring member 24. Thus, the base 8 having the motor 3 installed therein is elastically supported by the second water-resistant member 23, the spring 24 and the support frame 25 having an elastic piece 25*b*, thereby reducing the transmission of vibration from the motor 3 to the housing 1.

As shown in FIGS. 1 and 5, slide frames 26 are each slidably provided on both sides of the upper surface portion of the upper base portion 15, and an operating portion 26*a* coaxially protrudes from an outside edge of the slide frame 26. A support hook 26*b* extends from inside edge of the slide frame 26. Furthermore, a protrusion 26*c* for a stopper vertically extends from an upper.surface of one of the portions on the inside of the slide frame 26.

As shown in FIG. 1, the inside portions of both slide frames 26 are slidably fitted in the tunnel passage of the protrusion 15*g* for a tunnel, and the protrusion 26*c* for a stopper is slidably fitted in the hole 15*h* provided on the upper surface portion of the protrusion 15*g* for a tunnel. The protrusion 26*c* engages the edge of the hole 15*h* so that the slide frame 26 does not slip. Springs 26*d* are provided between the slide frames 26 in the tunnel passage of the protrusion 15*g*. The slide frames 26 are outwardly biased by the springs 26*d*. The protrusion 26*c* and the slide frames 26 serve as a hook attachment portion. Moreover, the operating portion 26*a* of the slide frame 26 is fitted in the hole 7*e* provided on the housing 1 and extends toward the outside from within the housing 1.

The rotatable cylinder 4, a cylinder attachment base 27, a cylinder cover 28, a cam 29, a holding spring 30 and a head frame 31 serve as the hair removing head 2, as shown in FIGS. 1, 2, 8 and 9.

The rotatable cylinder 4 has concave portions 4*a* each axially extending along the cylinder, the concave portions arranged in a circumferential direction (i.e., about the circumference of the cylinder 4). While the present invention has ten portions each occupying a space of thirty-six degrees in the preferred embodiment, it will be readily appreciable by those skilled in the art that a fewer or a greater number of portions may be used. For example, twelve portions each occupying thirty degrees about the circumference of the cylinder 4 may be used. A pair if fixed detents 5*b* radially extend from a respective end of each concave portion 4*a*, and a hole 5*b*1 is formed in each fixed detent 5*b*. Moreover, a main hair removing unit 32 is fitted in each concave portion 4*a*.

Figure 9:
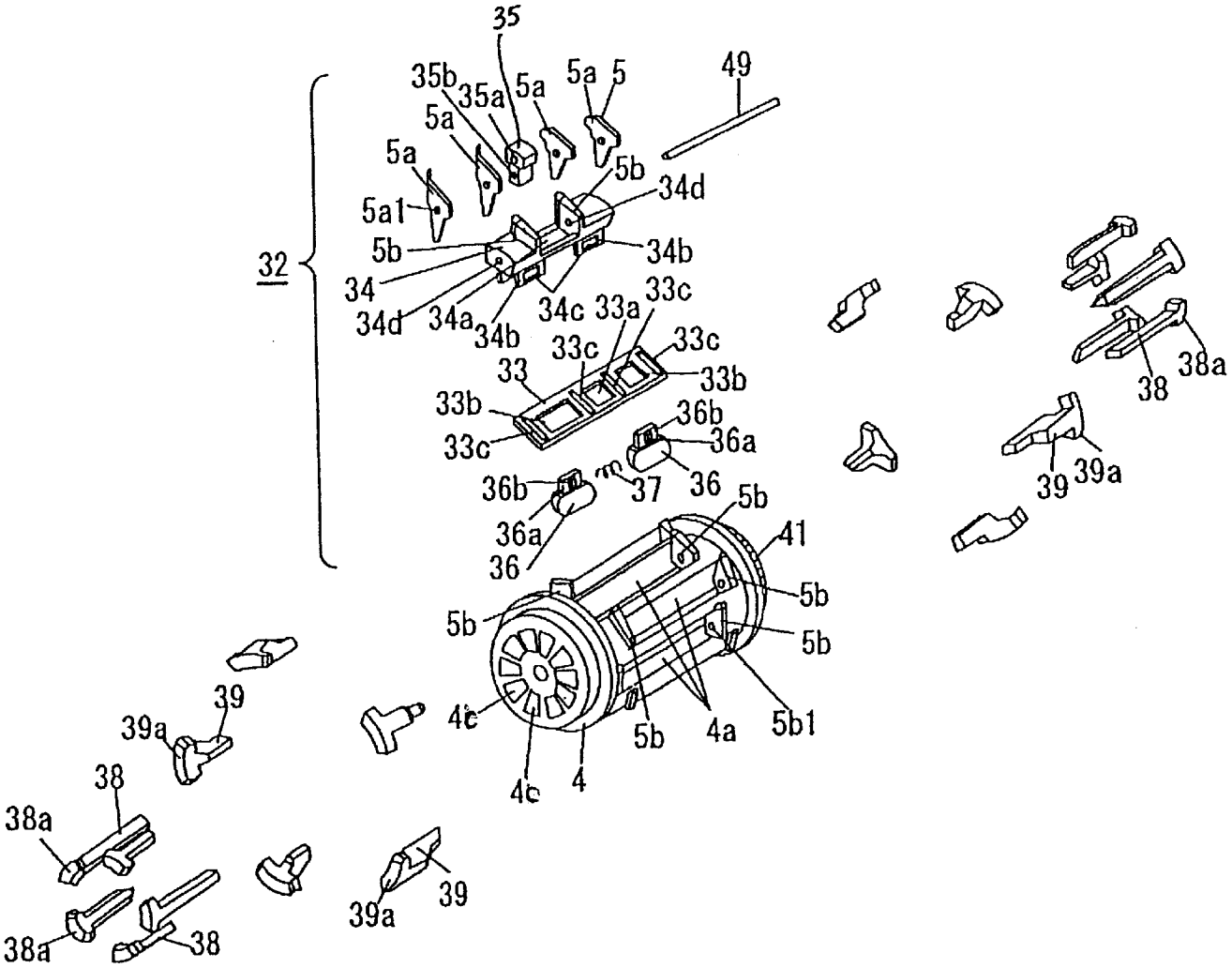
FIG. 9 is an exploded perspective view showing a rotatable cylinder portion of the hair removing device of the present invention.

The hair removing unit 32 includes a fulcrum plate 33, a plurality of movable detents 5*a*, a fulcrum stopping member 34, a spring receiving member 35, a transmission lever 36 and a spring 37 as shown in FIG. 9. While the present invention shows four movable detents 5*a* in the preferred embodiment, it will be readily appreciable by those skilled in the art that less or more movable detents may be used in alternative embodiments. The fulcrum plate 33 has a centrally-located rectangular hole 33*a* for accepting a spring receiver fitting therein. The fulcrum plate 33 further has a pair of rectangular holes 33*b* for rib fitting, each rectangular hole 33*b* provided on an opposite side of rectangular hole 33*a*. The fulcrum plate 33 additionally has four rectangular holes 33*c* for movable detent fitting, two of the rectangular holes 33*c* being located between the rectangular hole 33*a* and a respective rectangular hole 33*b*, and two of the rectangular holes 33*c* being located on a respective end of the fulcrum plate 33.

The fulcrum stopping member 34 is provided with a spring receiver fitting hole 34*a* in a central part, and second pair of fixed detents 5*b* extends radially outward from a respective opposed side of the spring receiver fitting hole 34*a*. Moreover, a set of two ribs 34*b* depend radially inwardly on both sides of a lower surface portion of the fulcrum stopping member 34, and a slot 34*c* is provided on each rib 34*b*. Furthermore, a hole 34*d* is provided in the fulcrum stopping member 34 in an axial (i.e., longitudinal) direction. The set of two ribs 34*b* provided on both sides of the fulcrum stopping member 34 are fitted in rectangular hole 33*c* on a respective opposed side thereof.

The spring receiving member 35 is provided with a hole 35*a* in an upper portion thereof, and with a spring inserting hole 35*b* in a lower portion thereof. The spring receiving member 35 is fitted in the spring receiver fitting hole 34*a* of the fulcrum stopping member 34 and is also fitted in the rectangular hole 33*a* of the fulcrum plate 33. Moreover, each movable detent 5*a* is provided with a hole 5*a*1. Of the four movable detents 5*a* of each hair removing unit 32, two movable detents 5*a* are inserted in the spring receiver fitting hole 34*b* between the fixed detent 5*b* and the spring receiving member 35, and is further inserted into the rectangular hole 33*b*. The other two of the four movable detents 5*a* are fitted in the other rectangular hole 33*b*. Furthermore, a protrusion 36*a* in the upper portion of each transmission lever 36 is fitted a respective rib 34, and an engaging protrusion 36*b* provided on a respective protruded piece 36*a* slidably engages the slot 34*c* of the rib 34*b*. One of the transmission levers 36 is provided between the lower portions of the two movable detents 5*a* on one side of the rectangular hole 33*a*, and the other transmission lever 36 is provided between the lower portions of the two movable detents 5*a* on the other of the rectangular hole. Furthermore, the spring 37 inserted into the spring inserting hole 35*b* outwardly urges (i.e., urges toward a respective end of the cylinder 4) the inner surfaces of the lower portions of both movable detents 5*b* in the central part (i.e., the inner two movable detents 5*b*).

The hair removing unit 32 is assembled as one unit. Each hair removing unit 32 is fitted in a respective concave portion 4*a* of the rotatable cylinder 4, and a shaft 49 is inserted through the hole 5*b* 1 formed in each fixed detent 5*b* that extends radially outward from a respective opposed side of the spring receiver fitting hole 34*a*, through the hole 34*d* of the fulcrum stopping member 34, through the hole 5*a*1 of each of the four movable detents 5*a*, and also through the hole 35*a* of the spring receiving member 35. The tip portion of the shaft 49 is fitted in the respective holes 5*b* 1 of the fixed detent 5*b* extending from a respective end of each concave portion 4*a* in order to attach the hair removing unit 32 to the concave portion 4*a*.

Figure 8:
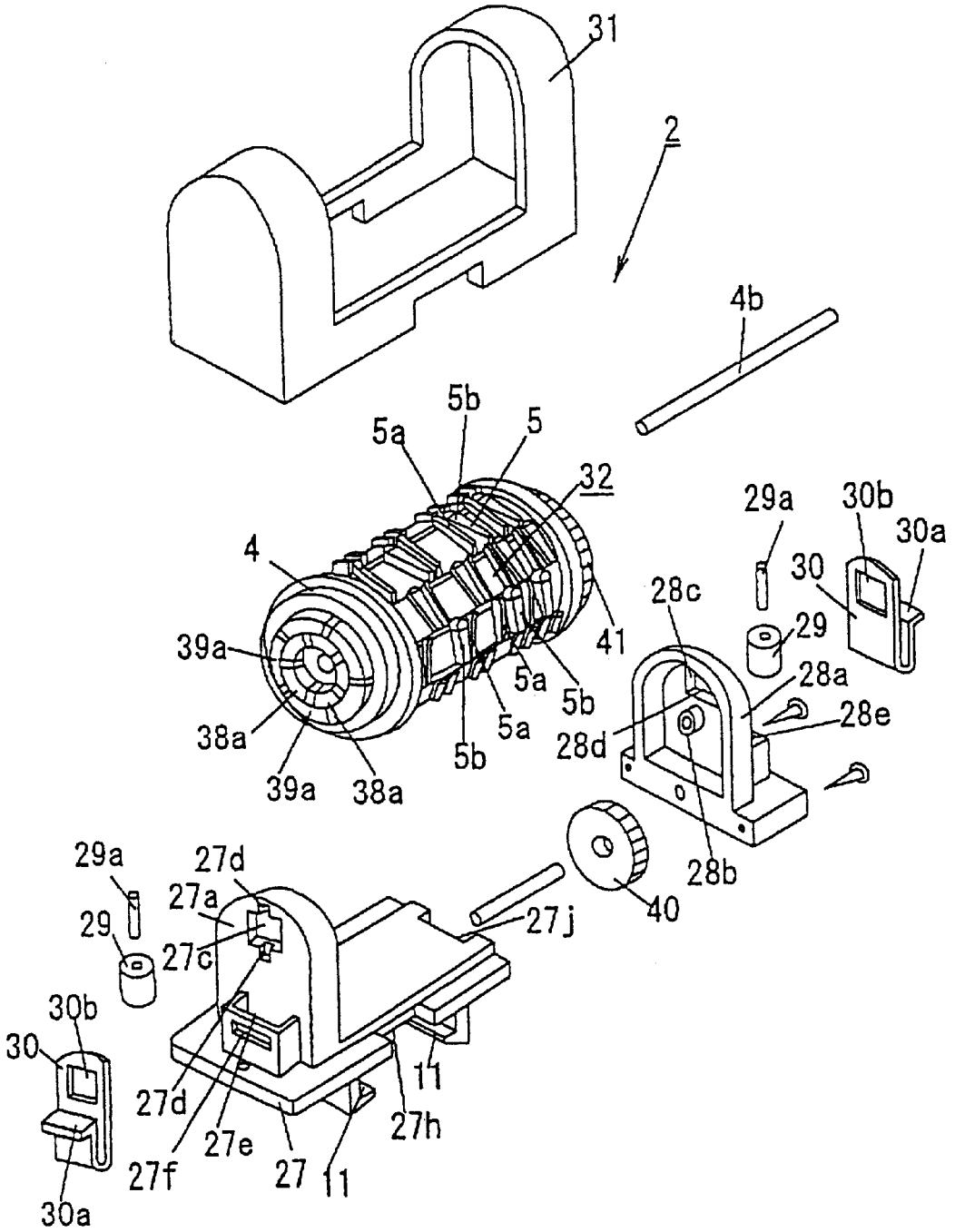
FIG. 8 is an exploded perspective view showing a hair removing head of the hair removing device of the present invention.

A plurality of holes 4c are formed in opposed end face portions in the axial direction of the rotatable cylinder 4 in a circumferential direction as shown in FIGS. 8 and 9. An opening lever 38 and an opening lever 39 are alternately inserted in the holes 4*c* provided on one of the end face portions in the axial direction of the rotatable cylinder 4 in the circumferential direction. A ring defined by the opening levers 39 is disposed about a ring defined by the opening levers 38, as shown in FIG. 8. A pressing portion 39*a* provided on the end of the opening lever 39 radially shifts a pressing portion 38*a* provided on an end of the opening lever 38. When the pressing portions 38*a* and 39*a* are shifted in the radial direction, both ends of the pressing portion 38*a* overlap with the end of the pressing portion 39*a* in the circumferential direction, as shown in FIG. 8.

Moreover, the opening lever 39 and the opening lever 38 are alternately inserted in the circumferential direction into the holes 4*c* provided on the other end face portion in the axial direction of the rotatable cylinder 4 in the same manner as described above. If one of the opening levers inserted into the hole 4*c* on one end face acts as the opening lever 38, the operating lever in the opposite hole 4*c* on the end face on the other side acts as the opening lever 39.

The concave portions 4*a* of the rotatable cylinder 4 are alternately shifted in the axial direction. Thus, the opening lever 39 has a smaller length as that of the opening lever 38. The ends of the opening levers 38 and 39 on both sides are in contact with the outer ends of a respective end of each transmission lever 36 of the hair removing unit 32. When the opening lever 39 is not pushed inward, the lower portions of the two movable detents 5*a* in the central part are pushed outward by the biasing force of the spring 37. Consequently, both transmission levers 36 are pushed outward so that the lower portions of the two movable detents 5*a* on the outside are pushed outward. Thus, the lower portions of the two movable detents 5*a* in the central part are pushed outward so that the two movable detents 5*a* in the central part are pivoted by using, as a fulcrum, an edge of the rectangular hole 33*c*, and the two movable detents 5*a* are further separated from the fixed detent 5*b* provided on the fulcrum stopping member 35. Moreover, the lower portions of the movable detents 5*a* located toward a respective edge of the cylinder 4, are pushed outward so that the two movable detents 5*a* located toward a respective edge are rotated by using, as a fulcrum, an edge of the rectangular hole 33*c*, and the two movable detents 5*a* are further separated from the fixed detent 5*b* provided on the rotatable cylinder 4.

As shown in FIG. 8, a shaft 4*b* is inserted into the rotatable cylinder 4, both ends of the shaft 4*b* of the cylinder 4 being rotatably supported on opposed shaft hole portions 28*b*, one shaft hole portion provided on a protrusion support portion 27*a* vertically extending from an upper surface portion on an end of the cylinder attachment base 27, the other shaft hole portion provided on a protrusion support portion 28*a* provided on the cylinder cover 28 attached to the other end of the cylinder attachment base 27.

As shown in FIG. 8, cam insertion holes 27*c* and 28*c* each having a square configuration are formed in the respective protrusion support portions 27*a* and 28*a*, and shaft support grooves 27*d* and 28*d* are each formed on respective upper and lower edges of the cam insertion holes 27*c* and 28*c*. A roller having a cam 29 is fitted in the cam insertion holes 27*c* and 28*c* respectively. A roller shaft 29*a* is inserted in each roller, one roller shaft being fitted in and supported on the shaft support groove 27*d*, the other roller shaft being fitted in and supported on the shaft support groove 28*d*. The roller is rotated about the shaft 29*a*.

Further, a part of each roller protrudes inward (i.e. toward the axial center of the shaft 4*b*) from the cam insertion holes 27*c* and 28*c*.

Holding spring fitting groove portions 27*e* and 28*e* are provided in respective outside lower portions of the protrusion support portions 27*a* and 28*a*. The U-shaped lower portion of each holding spring 30 is fitted in and supported on the respective holding spring fitting groove portions 27*e* and 28*e*, and an engaging protruded piece portion 30*a* provided in a U-shaped portion is engaged with and attached to respective engagement hole portions 27*f* and 28*f* provided on the respective holding spring fitting groove portions 27*e* and 28*e*. A hole portion 30*b* is formed in an upper portion of each holding spring 30. Both upper and lower ends of the roller shaft 29*a* are inwardly biased by the upper and lower edge parts of the hole portion 30*b*, and the hole portion 30*b* is configured so that the roller does not contact the holding spring 30.

A pair of hooks 11 depend downwardly (i.e., toward the motor 3) from the lower surface of the cylinder attachment base 27, and face each other in a direction parallel with the shaft 4*b* of the rotatable cylinder 4. A fitting concave portion 27*h* is formed in both side portions of the cylinder attachment base 27 in a direction orthogonal to the shaft 4*b* of the rotatable cylinder 4. Moreover, a concave notch portion 27*j* is provided on an end opposite the side of the cylinder attachment base 27 where the protrusion support portion 27*a* extends. A driving gear 40 is provided in the concave notch portion 27*j*, and one end of the shaft of the driving gear 40 is rotatably supported by the cylinder attachment base 27, and the other end of the shaft is rotatably supported by the cylinder cover 28. The upper portion of the driving gear 40 operably engages the gear 41 provided on the rotatable cylinder 4. The cylinder attachment base 27 and the cylinder cover 28 are combined and fastened with the rotatable cylinder 4 attached thereto, and the head frame 31 is then affixed thereto.

The hair removing head 2 is removably attachable to and detachable from to the housing 1. When the hair removing head 2 is to be attached, a pair of hooks 11 provided on the lower surface of the hair removing head 2 are fitted in the rectangular openings of both slide frames 26, with the respective operating portions 26*a* pushed inwardly. The operating portions 26*a* may then be released, and both slide frames 26 are then urged outward by the spring 26*d*, thereby engaging the support hook 26*b* with the hook 11 and attaching the hair removing head 2 to the housing 1. A pair of support protrusion pieces 15*i* vertically extending from the protruded portion 15*g*, are fitted in the fitting concave portion 27*h* of the cylinder attachment base 27 so that the hair removing head 2 is securely attached to the housing 1. When the hair removing head 2 is attached to the housing 1, the driving gear 40 engages the output gear 20. Accordingly, the rotational force of the motor 3 is transmitted to the gear 41 through the gear train so that the rotatable cylinder 4 may be rotated.

When the hair removing head 2 is to be removed, the operating portions 26*a* are inwardly pushed against the biasing force of the spring 26*d* so that the support hook 26*b* may be removed from the hook 11 in an order reversed from that described above. The hair removing head 2 may then be separated and removed.

Following is a description of hair removal using the present invention when the hair removing head 2 is attached to the housing 1.

When the motor 3 is rotated, the rotatable cylinder 4 is rotated through the gear train. When the rotatable cylinder 4 is rotated to a point where the pressing portions 38*a* and 39*a* of the opening levers 38 and 39 come to a position where they engage the roller of the cam 29, the opening levers 38 and 39 are pushed inward against the biasing force of the spring 37. The lower portion of the outer movable detents 5*a* are pushed inwardly by the tip portions of the opening levers 38 and 39, and the transmission levers 36 are in turn pushed inward and engage the respective lower portions of the outside movable detent 5*a* to inwardly push these lower portions. Thus, the lower portions of the four movable detents 5*a* are pushed inward so that the movable detents 5*a* are pivoted, and the upper portions of the movable detents 5*a* engage the fixed detents 5*b*, respectively. Consequently, hair introduced between the movable detent 5*a* and the fixed detent 5*b* is pinched (i.e., held or grabbed). When the rotatable cylinder 4 is rotated while the hair is being held, the hair is pulled out. Then, in the next sequence of opening levers 38 and 39 reach the roller through the rotation of the rotatable cylinder 4 and are pressed by the roller. Thus, the hair is held and pulled out in the same manner as described above. This process continues while the roller is rotating. As can be seen in FIGS. 1, 10, 12, 14, 16 and 17, the movable detents 5*a* and fixed detents 5*b* shown facing upward (i.e., facing outward and on the upper side of the shaft 4*b*) are shown engaged with one another (i.e., in a hair grasping position), while the movable detents 5*a* and fixed detents 5*b* shown facing downward (i.e, facing inward toward the motor 3 and on the lower side of the shaft 4*b*) are shown disengaged from one another (i.e., a hair releasing position). Thus over the course of rotation of rotatable cylinder 4, the movable detents 5*a* and the fixed detents 5*b* alternately engage and disengage each other.

As shown in FIG. 8, both ends of the pressing portion 38*a* of the opening lever 38 alternately provided in a circumferential direction overlap with the end of the pressing portion 39*a* of the opening lever 39 in the circumferential direction. Therefore, when a rear end in the direction of the rotation of the pressing portion of the opening lever contributing to the operation for holding the hair is pressed by the roller, the front end of the pressing portion of the next opening lever is pressed by the roller at the same time. Consequently, even if a plurality of detents 5 are provided in the circumferential direction of the rotatable cylinder 4, it is possible to increase a distance from which hair is held and pulled out.

While the hair is removed in the above-mentioned manner, hair, sebum and otherwise unwanted material can be prevented from entering the motor 3 side by the water-resistant member 6 provided at a middle region of the gear train.

When the hair removing device is to be cleaned, the water-resistant member 6 is provided so that hair, sebum and the like do not enter the housing beyond the portion where the water-resistant member 6 is provided, as described above. Therefore, the rotatable cylinder 4 portion of the invention may be cleaned since the water-resistant member 6 is in place. Consequently, cleaning of the invention may be easily carried out. Moreover, the water-resistant member 6 prevents water from entering the housing, which would otherwise damage the motor 3. Therefore, the cleaning can be carried out by washing with the area of the cylinder water so that the hair and the sebum can be removed easily and reliably. In this case, the hair and sebum wound or stuck onto the detent 5 and the gear can easily be removed by washing with water and/or a brush.

Figure 10:
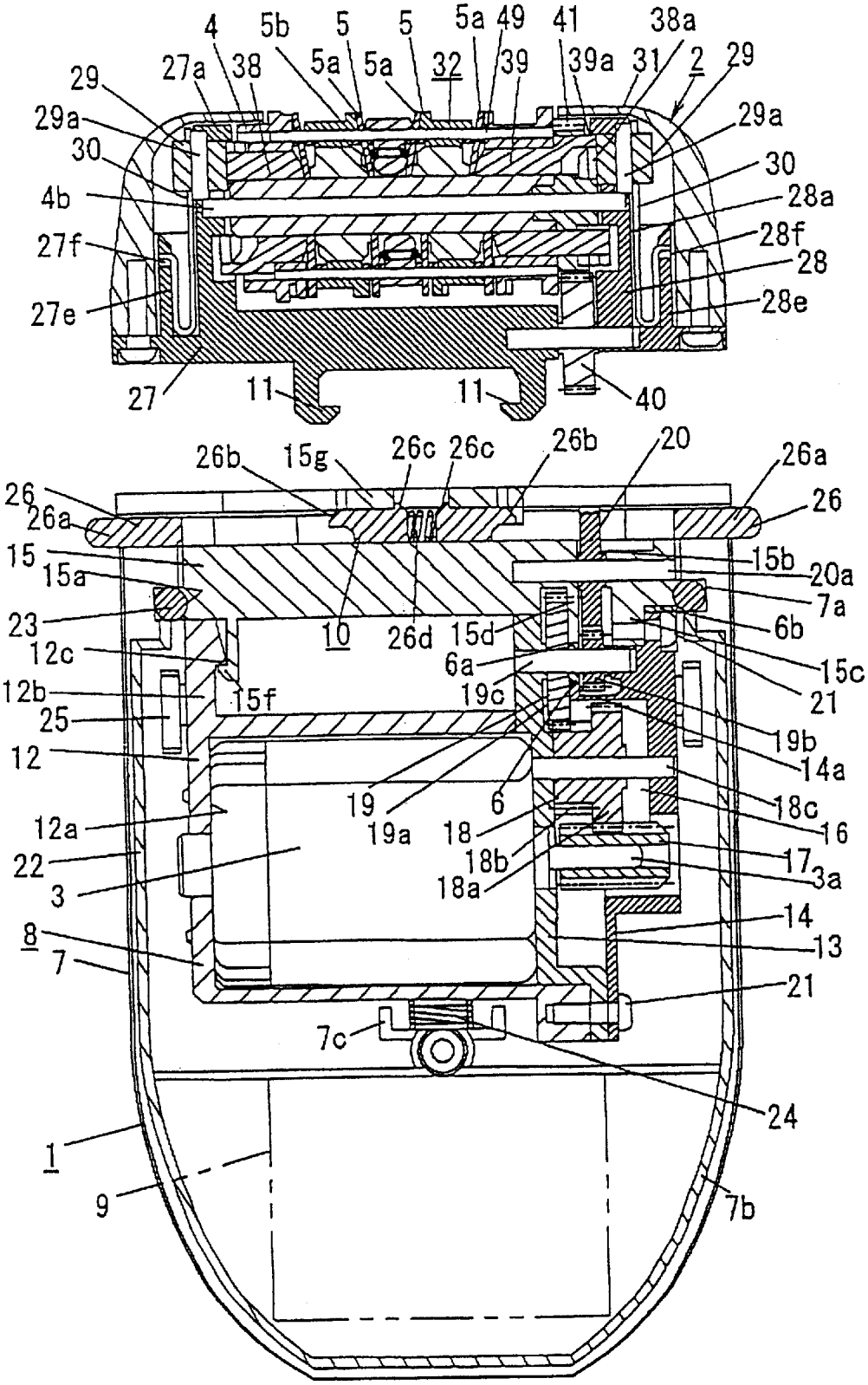
FIG. 10 is a sectional front view showing the hair removing head removed from a housing of the hair removing device of the present invention.

As in the above-mentioned embodiment, the hair removing head 2 which houses the rotatable cylinder 4 is removably attached to the housing 1. FIG. 10 shows the hair removing head 2 is removed from the housing 1 for cleaning. Thus, cleaning of the hair removing head 2 can easily be carried out. Preferably, only the separated hair removing head 2 should be washed with water, so that the hair, sebum and the like wound or stuck onto the rotatable cylinder 4, the detent 5 and the like, can be completely removed by water or other cleansing liquid.

As described above, the driving gear 40 extends from the lower surface portion of the hair removing head 2. Since the hook 11 provided on the lower surface of the hair removing head 2 extends beyond a position where the driving gear 40 extends, when the hair removing head 2 is removed for the cleaning or the like as described above. The driving gear 40 is prevented from hitting foreign objects, thereby preventing breakage of the gear 40 of the present invention.

Similarly, while the output gear 20 is exposed in the aperture 15*b* of the upper base portion 15, the hook attachment portion provided in the upper surface portion of the upper base portion 15 extends beyond a position where the output gear 20 extends. Therefore, when the hair removing head 2 is removed, the output gear 20 is prevented from hitting foreign objects, thereby preventing breakage of the device of the present invention.

While the operating portions 26*a* of the slide frame 26 extends from the hole 7*e* of the housing 1 as described above, the hole 7*e* from which the operating portion 26*a* extends is positioned closer to the upper opening of the housing 1 than the position of the second water-resistant member 6. Consequently, even if hair, sebum and water enter the housing 1 from the hole 7*e* through which the operating portion 26*a* protrudes, they do not enter the portion of the housing 1 in which the motor 3 is positioned.

A second embodiment will be described with reference to FIGS. 12 and 13. In the second embodiment, the annular member 6a may be pressed and supported vertically to water seal the housing by positioning the entire lower semicircular fitting portion 14*b* above the protruded wall portion 14*a*, pushing the lower surface of the annular member 6*a* of the water-resistant member 6 against the upper surface of the lower semicircular fitting portion 14*b* provided in the rising portion 14*b*, and pushing the lower surface of the upper semicircular fitting portion 15*e* of the suspended wall 15*d* against the upper surface of the annular member 6*a*.

Figure 12:
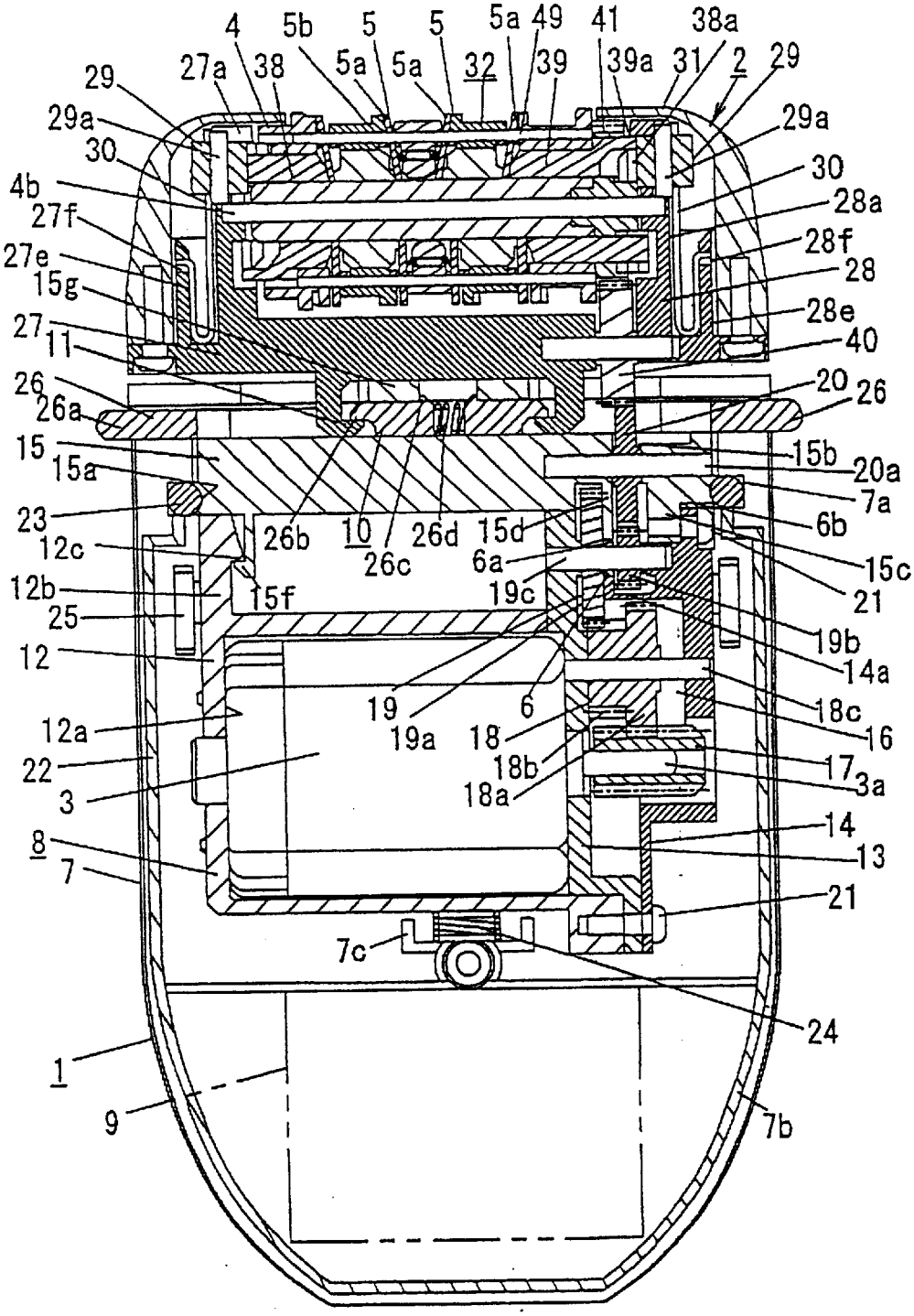
FIG. 12 is a sectional front view showing a second preferred embodiment of the present invention.
Figure 13:
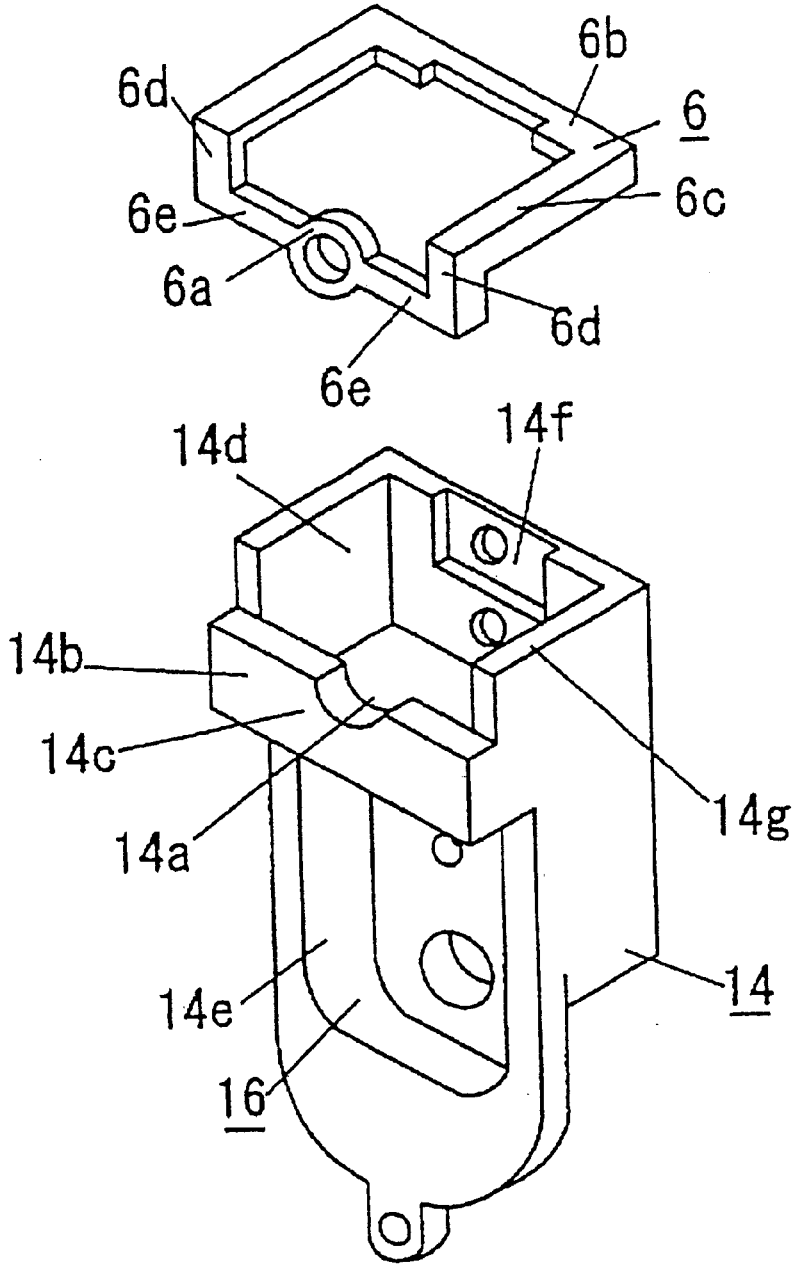
FIG. 13 is an exploded perspective view showing a water-resistant member and a gear cover base of the second embodiment of the present invention.

Also in the embodiment shown in FIG. 12, a reduction gear 19 connects two gears having different diameters through a clearance extending along a shaft 19*c* (that is, connects a large gear 19*a* and a small gear 19*b* through a clearance, or gap) and water-resistantly fits the annular member 6*a* of the water-resistant member 6 at a region between the large gear 19*a* and the small gear 19*b* of the shaft 19*c*. In the present embodiment, as shown in FIG. 12, it is not necessary to use a gear having such a complicated structure that the large gear 19*a*, the small gear 19*b* and a boss 19*d* are all integrally formed. Rather, the large gear 19*a* having a simple shape and the small gear 19*b* having a simple shape can be used.

Figure 11:
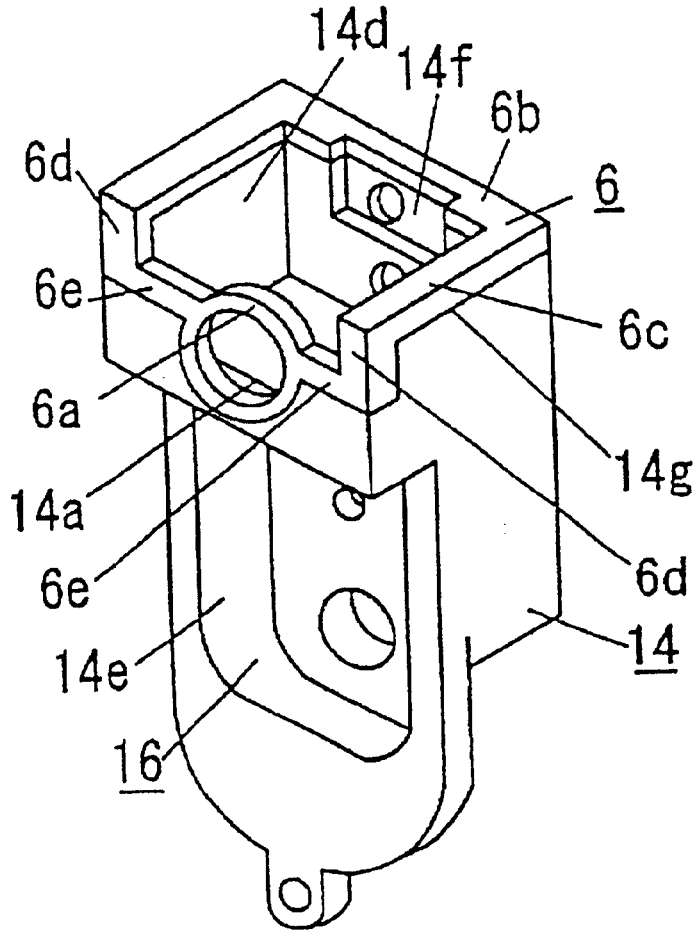
FIG. 11 is a perspective view showing an embodiment of the water-resistant member integrated with the gear cover base portion of the hair removing device of the present invention.

While the example in which the elastomeric water-resistant member 6 is separately formed from the base has been described the first and second embodiments, the water-resistant member 6 may be integrated with the base, as shown in FIG. 11. In FIG. 11, the water-resistant member 6 is integrally formed with the upper end of a gear cover base portion 14. The water-resistant member 6 may be bonded to the gear cover base 14 to function as a base 8, or integration may be carried out through two-color or multi-material molding.

Next, a third preferred embodiment of the present invention will be described with reference to FIGS. 14 and 15. In the third embodiment, a base includes a motor installing base portion 12 for housing a motor 3, a motor cover base portion 13 for covering the motor 3, and a gear cover base portion 14 for covering a gear train on the outside of the motor cover base 13. The three base portions 12, 13 and 14 are coupled and fastened together by a screw 21. A protrusion support portion 12*d* extends upwardly from an upper portion of the motor installing base portion at a position (i.e., substantially parallel to the axis of rotation of the motor) opposite where the motor cover base portion 13 and motor installing base portion 12 are to be connected. A protrusion support portion 14*i* extends upwardly from an upper portion of the gear cover base portion 14. Both protrusion support portions 12*d* and 14*i* provided on the bases each rotatably support an end of a shaft 4*b* of rotatable cylinder 4. In the third embodiment, the motor 3, the gear train and the rotatable cylinder 4 can easily be incorporated and installed in the base portions.

Figure 14:
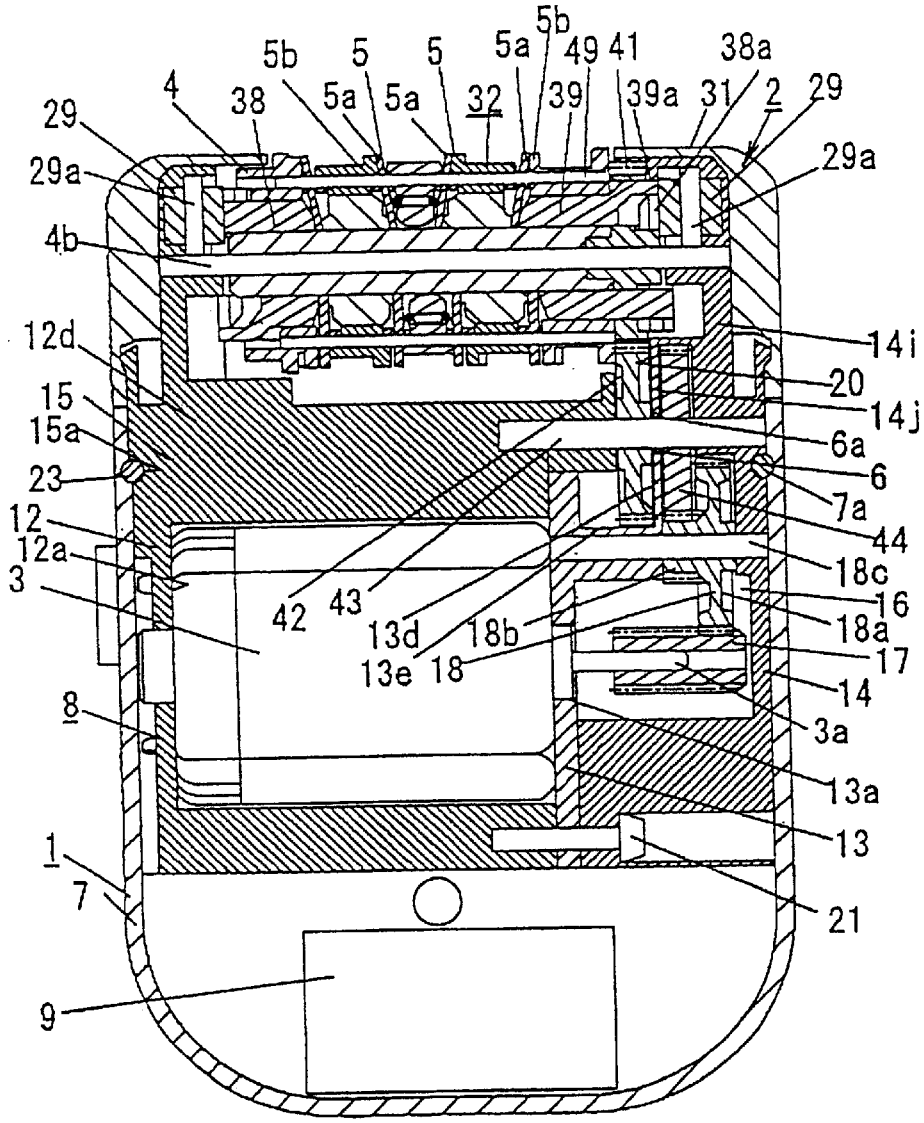
FIG. 14 is a sectional front view according to a third preferred embodiment of the present invention.
Figure 15:
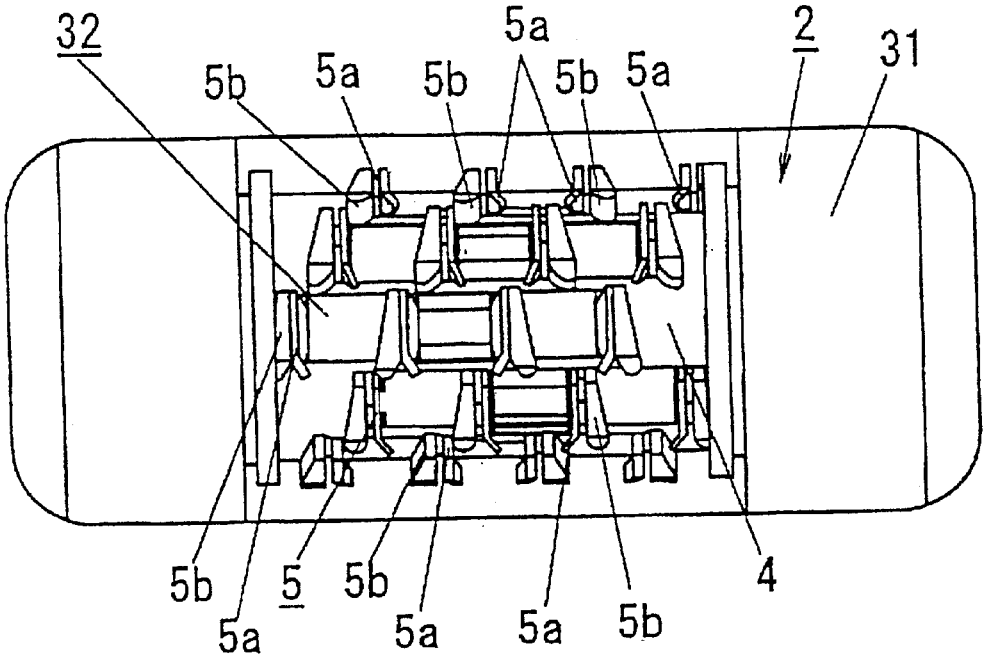
FIG. 15 is a plan view showing the third embodiment of the present invention.

In the third embodiment, as shown in FIG. 14, a protruded wall 13*e* is provided on the motor cover base portion 13, and a vertical partition is incorporated by a vertical partition portion 13*d* extending upward (i.e., toward the rotatable cylinder) from the protruded wall 13*e*. A second vertical partition portion 14*j* depends downwardly from the gear cover base portion 14, and a water-resistant member 6 is interposed between both vertical partition portions 13*d* and 14*j*. A space having the gear train provided therein is partitioned by the vertical partition to form, as an opening portion 42, a portion surrounded by the other end (i.e., and end where the motor cover base portion 13 and motor installing base portion 12 are to be connected) of the upper portion of the motor accommodating base 12 and the vertical partition. A shaft 43 water-resistantly penetrates through an annular member 6*a* provided on the water-resistant member 6 and is positioned in the central part of the partition, and one end of the shaft 43 is rotatably supported by the gear cover base portion 14 and another end of the shaft 43 is rotatably supported by the motor installing base portion 12. Moreover, an axial half of one of the sides of the shaft 43 extends across the opening portion 42. Gears are fastened to both sides of the shaft 43 through the respective vertical partitions. The gear positioned on same side of the partition as the motor 3 side functions as an input gear 44 to which rotation is transmitted from the motor, and the gear positioned on the same side of the partition as the opening portion 42 functions as an output gear 20.

The output gear 20 operably engages a gear 41 provided on the rotatable cylinder 4. Accordingly, in the third embodiment, the output gear 20 is a final stage gear of the gear train for transmitting the rotation of the motor 3 to the gear 41, and the shaft portion of the final stage gear is substantially water-resistantly sealed by the water-resistant member 6. Therefore, only the rotatable cylinder 4 and the final stage gear 20 in the gear train need to be cleaned, and other gears of the gear train (i.e., the gears connecting the final stage gear to the motor) do not need to be cleaned. Consequently, cleaning can easily be carried out. Moreover, hair, sebum and the like can easily be removed by washing with water.

While the rotatable cylinder 4 is not removable from the housing 1 in the third embodiment, a hair removing head 2 housing the rotatable cylinder 4 may be removable from the housing 1 in the same manner as that in the above-mentioned embodiments. Also in such a configuration, the shaft of the final gear of the gear train or a boss portion may be water sealed by the water-resistant member 6. In the present embodiment, there is no gear other than the gear 41 provided in the rotatable cylinder 4 on in the removable hair removing head 2, and the hair removing head 2 can easily be removed for cleaning.

Also in the present embodiment, the water-resistant member 6 may be integrally formed with one of the divided bases 8.

Figure 16:
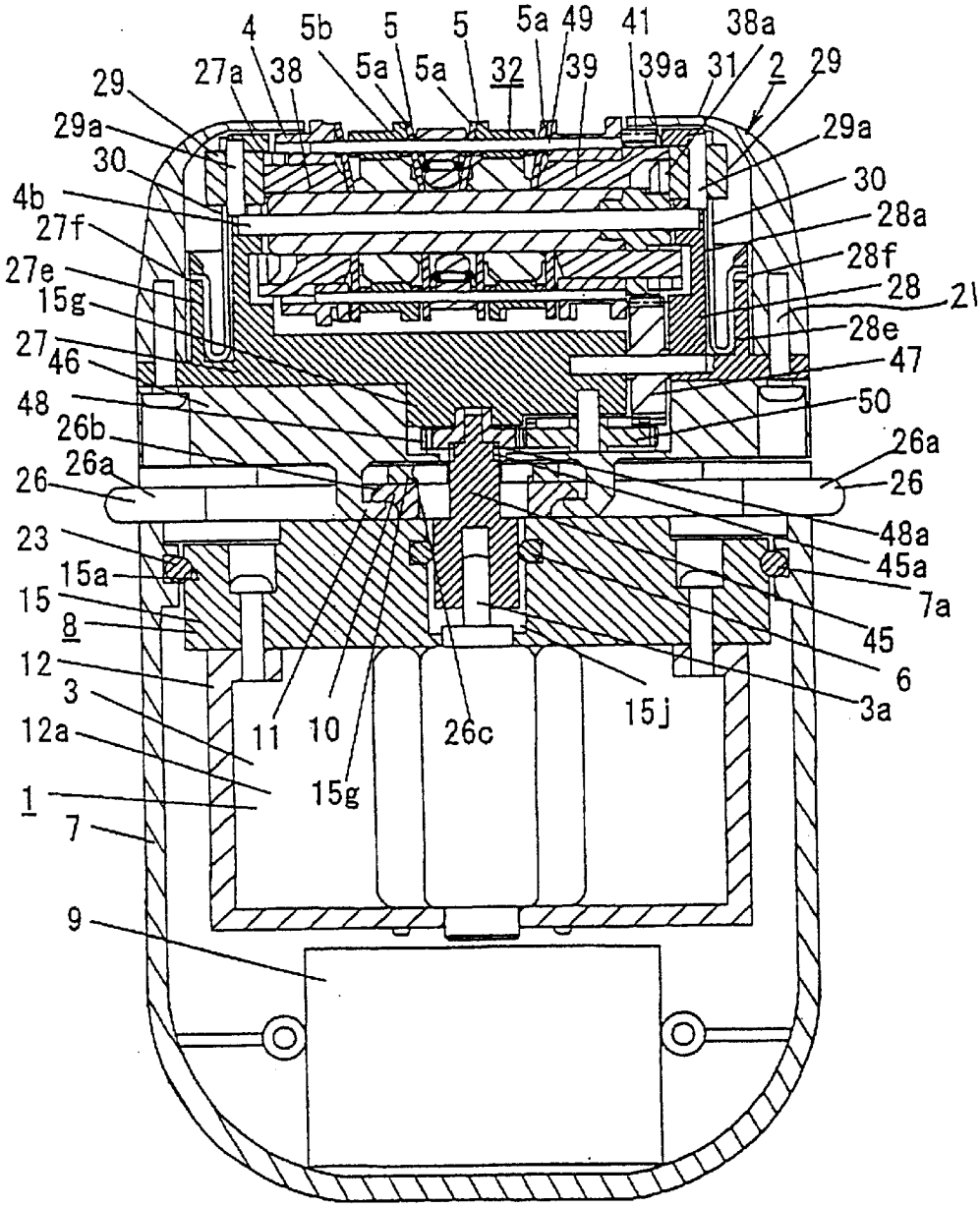
FIG. 16 is a sectional front view according to a fourth preferred embodiment of the present invention.
Figure 17:
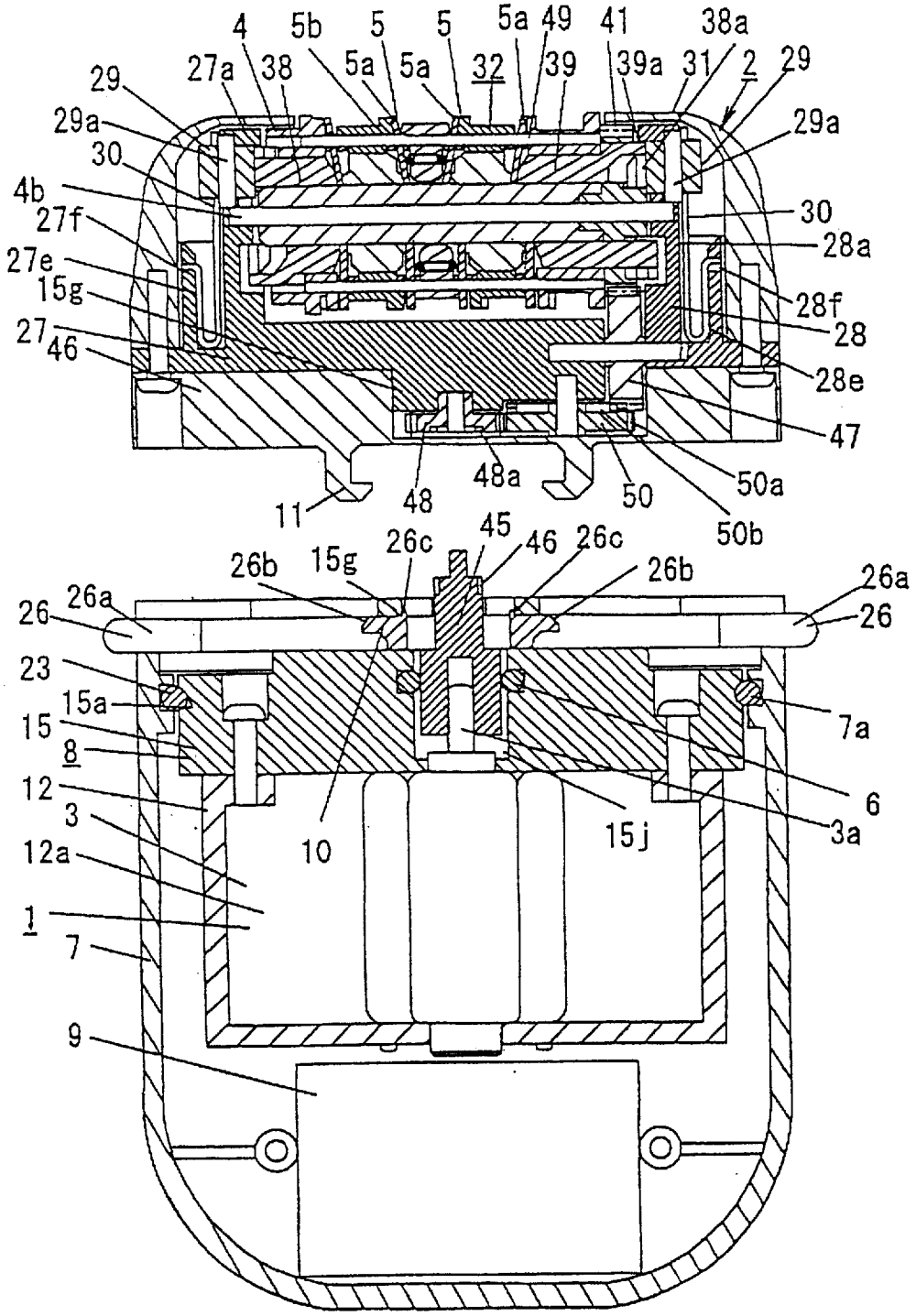
FIG. 17 is a sectional front view showing the hair removing head removed from a housing according to the fourth embodiment of the present invention.
Figure 18:
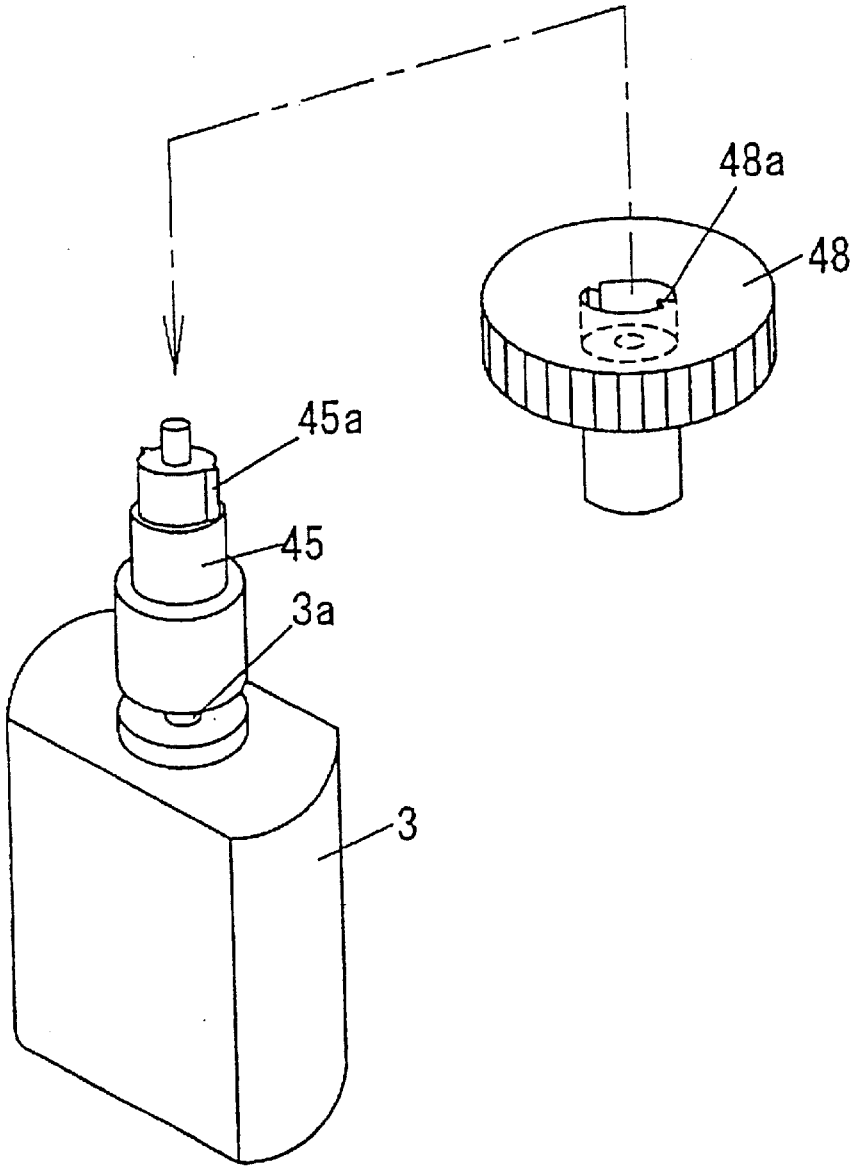
FIG. 18 is an exploded perspective view showing an engaging portion provided on a rotary shaft and an engaged portion provided on a gear according to the fourth embodiment of the present invention.
Figure 19:
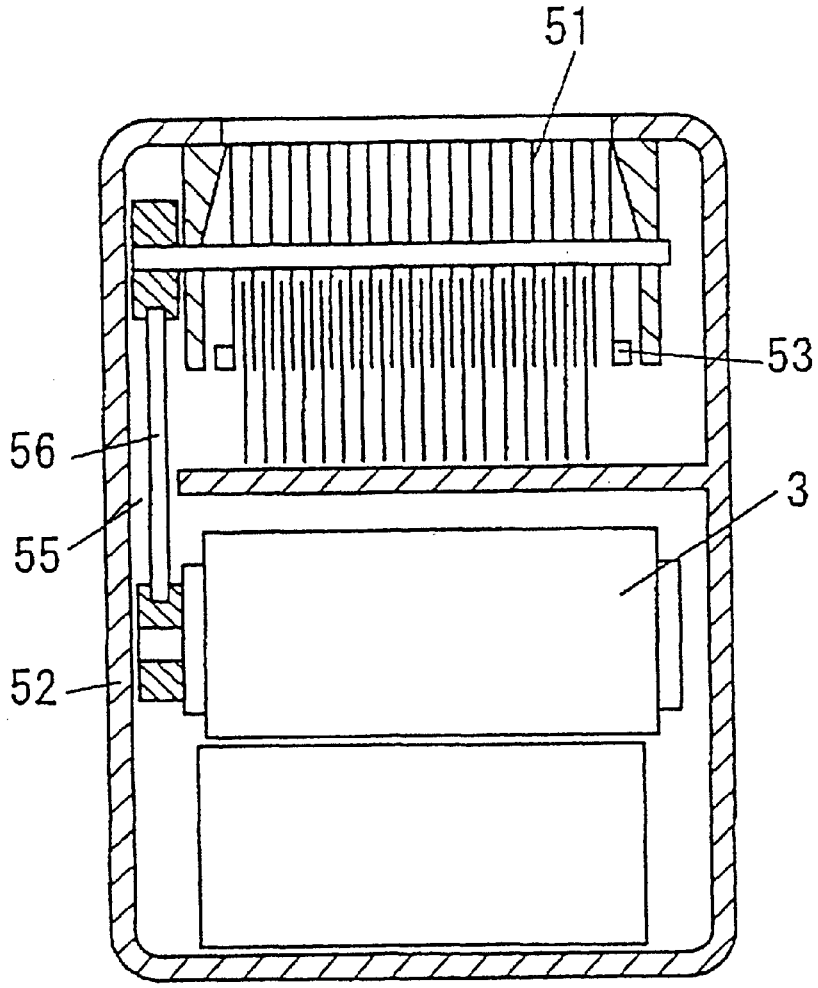
PRIOR ART FIG. 19
FIG. 19 is a sectional front view showing a related art hair removing device.
Figure 20:
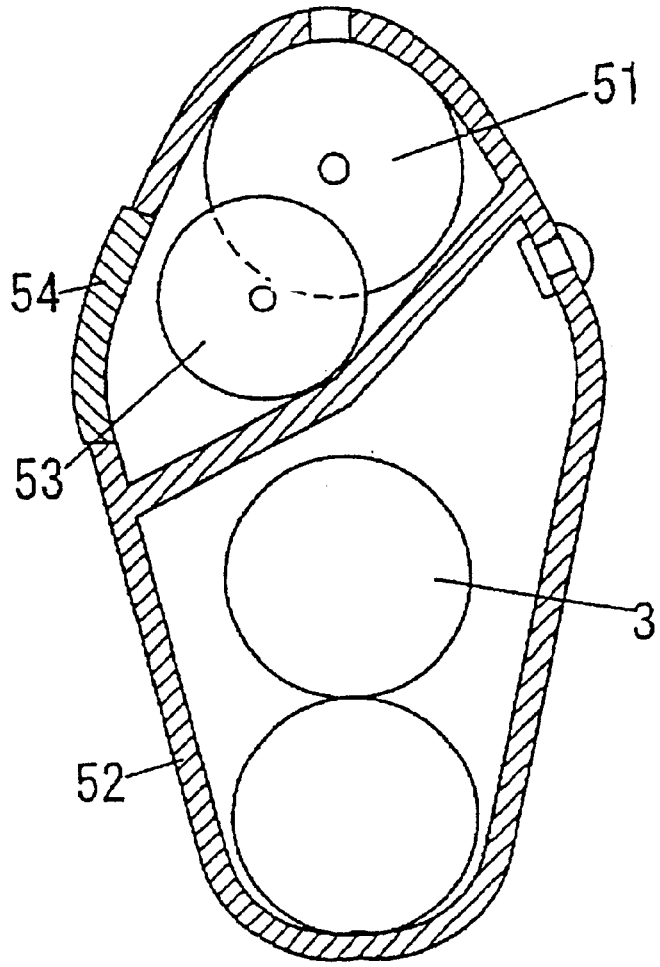
FIG. 20 PRIOR ART
FIG. 20 is a sectional side view showing the related art hair removing device.

Next, a fourth embodiment of the present invention will be described with reference to FIGS. 16 to 18. In the fourth embodiment, an upper base portion 15 is fastened to the top of a motor installing base portion 12 having a motor 3 disposed therein, thereby forming a base 8. The base 8 having the motor 3 provided therein is installed in a housing 1 and a second water-resistant member 23 is provided between the housing 1 and an upper outer periphery of the upper base portion 15. A rotary shaft 45 is fitted and fastened onto an output shaft 3*a* of the motor 3 and extends vertically (i.e., in a direction substantially parallel to a longitudinal axis of the housing) through an aperture 15*j* formed on the top of the upper base portion 15. The upper end of the rotary shaft 45 extends toward the outside of the housing (and into the cover 2 when the cover is attached to the housing 1) through an aperture provided on the upper surface portion of a protruded portion 15*g* for a tunnel provided in the upper surface portion of the upper base portion 15. A water-resistant member 6 is provided between an inner peripheral surface portion of the hole 15*j* of the upper base portion 15 and an outer peripheral portion of the rotary shaft 45. Thus, when the upper opening of the housing 1 is covered with the upper base portion 15, the water-resistant member 6 and the second water-resistant member 23 to prevent hair, sebum, water and other unwanted matter from entering the inside of the housing. Further, an engaging portion 45*a* is formed in the upper portion of the rotary shaft 45.

A hook attachment portion 10 is provided on the top of the upper base 15 in the same manner as that in the above-described embodiments. A hair removing head 2 includes a rotatable cylinder 4 including a hair removing unit 32, a cylinder attachment base portion 27, a head-side lower base portion 46, a cylinder cover 28, a cam 29, a holding spring 30 and a head frame 31.

The cylinder attachment base portion 27 and the cylinder cover 28 are provided in the head frame 31, and furthermore, the head lower base portion 46 is provided under a lower surface portion of the cylinder attachment base portion 27 and a lower surface portion of the cylinder cover 28. The cylinder attachment base portion 27, the cylinder cover 28, the head frame 31, and the head lower base portion 46 are all fastened together by a screw 21. Since the structures of the hair removing unit 32, the rotatable cylinder 4, the holding spring 30 and the like are the same as those described above, description thereof will be omitted herein. A gear train is provided in the hair removing head 2, and a final gear 47 in the gear train operably engages a gear 41 provided in the rotatable cylinder 4. An opening portion is formed in a central area of the head lower base portion 46, and a starting gear 48 on the starting end of the gear train is provided in the opening portion. A gear portion 50*a* that operably engages the starting gear 48 is provided in an outer peripheral surface portion between the starting gear 48 and the final gear 47. A gear 50 has a face gear potion 50*b* in an upper surface portion thereof, and the face gear portion 50*b* and the final gear 47 on the final end operably engage each other. An engaged portion 48*a* configured to freely engage and disengage an engaging portion 45*a* of the rotary shaft 45, is provided in the lower surface portion of the starting gear 48. Moreover, a hook 11 extends downward (i.e., toward the housing 1) from the lower surface portion of the head lower base portion 46.

In the fourth embodiment, the hook 11 is removably attachable to and detachable from the hook attachment portion 10 in the same manner as that in the above-mentioned embodiments so that the hair removing head 2 may be easily attached to and removed from the housing 1. In FIG. 16, the engaged portion 48*a* of the starting gear 48 is shown engaged with the engaging portion 45*a* of the rotary shaft 45. Accordingly, the rotation of the motor 3 causes the rotatable cylinder 4 to be rotated through rotation rotary shaft 45 and a gear train provided in the hair removing head 2, so that hair may be grabbed and pulled out through a detent 5 provided on the rotatable cylinder 4. The water-resistant member 6 can prevent hair, sebum and other unwanted material from entering the housing 1.

The invention may cleaned while the hair removing head 2 is attached to the housing 1, or alternatively, the invention may be cleaned with the hair removing head 2 removed from the housing 1. The water-resistant member 6 can prevent water from entering the housing 1, and cleaning with water can be performed, while at the same time preventing water from entering the motor 3 through the housing, thereby preventing damage to the invention. Moreover, the hair removing head 2 may be removed from the housing 1 by disengaging the hook 11 from the hook attachment portion 10. Accordingly, the hair removing head 2 and the portion of the housing 1 facing the head 2 can each be cleaned. Thus, the lower surface of the hair removing head 2 and the upper surface of the housing 1 (which face each other when the head 2 is affixed to the housing 1) can be exposed and cleaned, respectively. The hair removing device of the present invention may be more effectively washed when the hair removing head 2 is separated from the housing 1.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present disclosure relates to subject matter contained in Japanese Patent Application No. 11-333562, filed Nov. 25, 1999, the content of which is expressly incorporated herein by reference in its entirety.

What is claimed is:

1. A hair removing device comprising:

a rotatable cylinder having a hair removing unit provided with a plurality of detents configured to engage and disengage each other, said hair removing unit configured to pull out hair through rotation of said rotatable cylinder;

a driving source configured to rotate said rotatable cylinder;

a drive transmission configured to transmit driving force from said driving source to said rotatable cylinder; and a housing having a handheld configuration and configured to house at least said driving source and at least a portion of said drive transmission;

wherein said drive transmission comprises a first water-resistant member configured to substantially water-resistantly seal said driving source.

2. The hair removing device according to claim 1, further comprising:

a rotatable cylinder gear operably connected to said rotatable cylinder; and wherein:

said drive transmission comprises a gear train configured to transmit the driving force from said driving source to said rotatable cylinder gear; and said gear train is provided with said first water-resistant member.

3. The hair removing device according to claim 2, wherein:

said first water-resistant member is further configured to substantially water-resistantly seal a portion of said gear train provided in said housing; and said rotatable cylinder is removable from and attachable to said housing.

4. The hair removing device according to claim 3, wherein said gear train further comprises a driving gear operably connected to said rotatable cylinder gear, said hair removing device further comprising:

a hair removing head that houses said rotatable cylinder and said driving gear, said head being removable from and attachable to said housing; and an output gear operably connected to said driving source, wherein said driving gear is driveably connected to said output gear when said head is attached to said housing.

5. The hair removing device according to claim 2, wherein said first water-resistant member is further configured to substantially water-resistantly seal a shaft portion of a gear of said gear train that is exposed in said housing, said gear of said gear train configured to engage said rotatable cylinder gear.

6. The hair removing device according to claim 1, further comprising:

a hair removing head that houses said rotatable cylinder, said head removable from and attachable to said housing; and a rotary shaft protruding from said housing and driveably connected to said driving source; wherein:

said rotatable cylinder is driveably connected to said rotary shaft when said head is attached to said housing; and said first water-resistant member is further configured to substantially water-resistantly seal said housing at a region of said rotary shaft.

7. The hair removing device according to claim 6, further comprising a rotatable cylinder gear operably connected to said rotatable cylinder, wherein:

said drive transmission comprises a gear train configured to transmit the driving force from said driving source to said rotatable cylinder gear when said hair removing head is attached to said housing; and at least a portion of said gear train is housed in said hair removing head.

8. A hair removing device comprising:

a rotatable cylinder having a hair removing unit provided with a plurality of detents configured to engage and disengage each other, said hair removing unit configured to pull out hair through rotation of said rotatable cylinder;

a driving source configured to rotate said rotatable cylinder;

a drive transmission configured to transmit driving force from said driving source to said rotatable cylinder;

a housing having a handheld configuration and configured to house at least said driving source and at least a portion of said drive transmission;

a first water-resistant member affixed to said housing at substantially a middle portion of said drive transmission and configured to substantially water-resistantly seal said driving source;

a rotatable cylinder gear operably connected to said rotatable cylinder; and wherein:

said drive transmission comprises a gear train configured to transmit the driving force from said driving source to said rotatable cylinder gear; and said gear train is provided with said first water-resistant member; and a base housed within said housing and comprising a plurality of base portions, at least one of said base portions configured to rotatably support a shaft of a gear of said gear train, wherein said first water-resistant member comprises:

a first water-resistant portion configured to substantially water-resistantly seal a region of said gear of said gear train; and a second water-resistant portion configured to substantially water-resistantly seal a region between said base portion configured to rotatably support said shaft of said gear of said gear train and another said base portion.

9. The hair removing device according to claim 8, wherein said first and second water-resistant portions are integrally formed with said base portion and are configured to rotatably support the shaft of said gear of said gear train.

10. The hair removing device according to claim 8, wherein:

said driving source further comprises a motor operably connected to said gear train; and a plurality of said plurality of said base portions are configured to house said motor and at least a portion of said gear train.

11. The hair removing device according to claim 8, further comprising:

a boss provided on one of said gear of said gear train and said shaft of said gear train; wherein said first water-resistant portion comprises an annular member fitted on said boss; and said second water-resistant portion comprises a band-shaped frame member configured to continuously substantially water-resistantly seal said region between said base portion configured to rotatably support said shaft of said gear of said gear train and said another said base portion.

12. A hair removing device comprising:

a rotatable cylinder having a hair removing unit provided with a plurality of detents configured to engage and disengage each other, said hair removing unit configured to pull out hair through rotation of said rotatable cylinder;

a driving source configured to rotate said rotatable cylinder;

a drive transmission configured to transmit driving force from said driving source to said rotatable cylinder;

a housing having a handheld configuration and configured to house at least said driving source and at least a portion of said drive transmission;

a first water-resistant member affixed to said housing at substantially a middle portion of said drive transmission and configured to substantially water-resistantly seal said driving source;

a rotatable cylinder gear operably connected to said rotatable cylinder; and wherein:

said drive transmission comprises a gear train configured to transmit the driving force from said driving source to said rotatable cylinder gear; and said gear train is provided with said first water-resistant member; and a base housed within said housing and comprising a plurality of base portions, at least one of said base portions configured to rotatably support a shaft;

a pair of gears of said gear train coaxially positioned about said shaft;

wherein at least a portion said first water-resistant member is positioned between said pair of gears.

13. A hair removing device comprising:

a rotatable cylinder having a hair removing unit provided with a plurality of detents configured to engage and disengage each other, said hair removing unit configured to pull out hair through rotation of said rotatable cylinder;

a driving source configured to rotate said rotatable cylinder;

a drive transmission configured to transmit driving force from said driving source to said rotatable cylinder;

a housing having a handheld configuration and configured to house at least said driving source and at least a portion of said drive transmission;

a first water-resistant member affixed to said housing at substantially a middle portion of said drive transmission and configured to substantially water-resistantly seal said driving source;

a rotatable cylinder gear operably connected to said rotatable cylinder; and wherein:

said drive transmission comprises a gear train configured to transmit the driving force from said driving source to said rotatable cylinder gear; and said gear train is provided with said first water-resistant member; and wherein said driving source further comprises a motor operably connected to said gear train, the hair removing device further comprising:

a base housed within said housing, said base in turn housing said motor; and a second water-resistant member positioned between said housing and an upper outer periphery of said base.

14. The hair removing device according to claim 13, wherein said base comprises an aperture for accepting at least a portion of a gear of said gear train, said hair removing device further comprising a drive transmission passage extending between said motor and said aperture, wherein said first water-resistant member is provided at a substantially middle portion of said drive transmission passage.

15. The hair removing device according to claim 14, wherein said base further comprises a motor installing base portion configured to accept said motor therein, the hair removing device further comprising:

a gear train installing portion configured to accept at least another portion of said gear of said gear train; and a partition configured to separate said motor installing base portion and said gear train installing portion.

16. The hair removing device according to claim 13, wherein said housing is longitudinally divided into two half-housings affixed to one another, said hair removing device further comprising a third water-resistant member positioned between at least a portion of said two half-housings.

17. A hair removing device comprising:

a rotatable cylinder having a hair removing unit provided with a plurality of detents configured to engage and disengage each other, said hair removing unit configured to pull out hair through rotation of said rotatable cylinder;

a driving source configured to rotate said rotatable cylinder;

a drive transmission configured to transmit driving force from said driving source to said rotatable cylinder;

a housing having a handheld configuration and configured to house at least said driving source and at least a portion of said drive transmission;

a first water-resistant member affixed to said housing at substantially a middle portion of said drive transmission and configured to substantially water-resistantly seal said driving source;

a rotatable cylinder gear operably connected to said rotatable cylinder; and wherein:

said drive transmission comprises a gear train configured to transmit the driving force from aid driving source to said rotatable cylinder gear; and said gear train is provided with said first water-resistant member; and wherein:

said driving source comprises a motor operably connected to said gear train;

said first water-resistant member comprises an annular member; and said base further comprises:

1) a motor installing base portion configured to accept said motor therein; and 2) an upper base portion having an aperture therein, the hair removing device further comprising:

a gear train installing portion configured to accept at least a portion of a gear of said gear train, said gear train comprising:

a) a first reduction gear having a small gear and a large gear coaxial to one another;

b) a second reduction gear having a small gear and a large gear coaxial to one another, said large gear of said second reduction gear operably connected to said small gear of said first reduction gear;

c) a boss portion positioned between said small gear and said large gear of said second reduction gear, said annular member being fitted on said boss portion;

an output shaft operably connected to said motor and protruding into said gear train installing portion; and d) an output gear operably connected to said small gear of said second reduction gear, wherein at least a portion of said output gear is housed within said aperture of said upper base portion; and a pinion affixed to said output shaft, wherein said large gear of said first reduction gear is operably connected to said pinion;

wherein said first water-resistant member is configured to substantially water-resistantly seal said driving source at at least a portion of at least one of said first and second reduction gears.

18. A hair removing device comprising:

a rotatable cylinder having a hair removing unit provided with a plurality of detents configured to engage and disengage each other, said hair removing unit configured to pull out hair through rotation of said rotatable cylinder;

a driving source configured to rotate said rotatable cylinder;

a drive transmission configured to transmit driving force from said driving source to said rotatable cylinder;

a housing having a handheld configuration and configured to house at least said driving source and at least a portion of said drive transmission;

a first water-resistant member affixed to said housing at substantially a middle portion of said drive transmission and configured to substantially water-resistantly seal said driving source;

a hair removing head that houses said rotatable cylinder, said head removable from and attachable to said housing; and a rotary shaft protruding from said housing and driveably connected to said driving source; wherein:

said rotatable cylinder is driveably connected to said rotary shaft when said head is attached to said housing; and said first water-resistant member is further configured to substantially water-resistantly seal said housing at a region of said rotary shaft; and wherein said driving source further comprises a motor, the hair removing device further comprising:

a base housed within said housing, said base housing said motor and having an aperture therein;

a second water-resistant member positioned between said housing and an upper outer periphery of said base; and a rotary shaft driveably connected to said motor and said gear train, said rotary shaft protruding through said aperture; wherein said first water-resistant member is positioned between an inner peripheral portion of said aperture and an outer peripheral portion of said rotary shaft.

19. A hair removing device comprising:

a rotatable cylinder having a hair removing unit provided with a plurality of detents configured to engage and disengage each other, said hair removing unit configured to pull out hair through rotation of said rotatable cylinder;

a driving source configured to rotate said rotatable cylinder;

a drive transmission configured to transmit driving force from said driving source to said rotatable cylinder;

a housing having a handheld configuration and configured to house at least said driving source and at least a portion of said drive transmission;

a first water-resistant member affixed to said housing at substantially a middle portion of said drive transmission and configured to substantially water-resistantly seal said driving source;

a hair removing head that houses said rotatable cylinder, said head removable from and attachable to said housing; and a rotary shaft protruding from said housing and driveably connected to said driving source; wherein:

said rotatable cylinder is driveably connected to said rotary shaft when said head is attached to said housing; and said first water-resistant member is further configured to substantially water-resistantly seal said housing at a region of said rotary shaft;

a rotatable cylinder gear operably connected to said rotatable cylinder, wherein:

said drive transmission comprises a gear train configured to transmit the driving force from said driving source to said rotatable cylinder gear when said hair removing head is attached to said housing; and at least a portion of said gear train is housed in said hair removing head; and wherein:

said rotary shaft further comprises an engaging portion on an end thereof;

said gear train comprises a gear disposed within said hair removing head and operably connected to said rotatable cylinder gear, said gear comprising a fitting aperture configured to accept said rotary shaft, said fitting aperture comprising an engaged portion for removably engaging said engaging portion.

20. A hair removing method using a hair removing device having a housing having a handheld configuration, a driving source connected to a rotatable cylinder via a drive transmission, the rotatable cylinder having a hair removing unit provided with a plurality of detents, the method comprising:

housing at least the driving source and at least a portion of the drive transmission;

rotating the rotatable cylinder via the driving source;

opening at least one of the plurality of detents;

closing the at least one of the plurality of detents;

substantially water-resistantly sealing said driving source with a first water-resistant member provided in the drive transmission.

21. The hair removing method according to claim 20, wherein the drive transmission comprises a gear train, the method further comprising:

operably connecting a rotatable cylinder gear to the rotatable cylinder transmitting driving force from the driving source to the rotatable cylinder gear; and providing the gear train with the first water-resistant member.

22. The hair removing method according to claim 21, further comprising:

substantially water-resistantly sealing a portion of the gear train provided in the housing, using the first water-resistant member; and configuring the rotatable cylinder so that it is removable from and reattachable to the housing.

* * * * *

UNITED STATES PATENT AND TRADEMARK OFFICE

CERTIFICATE OF CORRECTION

PATENT NO. : 6,620,175 B1
DATED : September 16, 2003
INVENTOR(S) : H. Sueyoshi et al.

It is certified that error appears in the above-identified patent and that said Letters Patent is hereby corrected as shown below:

Title page,
Item [57], ABSTRACT,
Line 13, after "middle" delete ",".

Column 25,
Line 62, "aid" should be -- said --.

Signed and Sealed this

Eighteenth Day of May, 2004

JON W. DUDAS
*Acting Director of the United States Patent and Trademark Office*